US006969161B2

(12) United States Patent
Kuwabara et al.

(10) Patent No.: US 6,969,161 B2
(45) Date of Patent: Nov. 29, 2005

(54) INK SUPPLY SYSTEM, INK JET PRINTING APPARATUS, INK CONTAINER, INK REFILLING CONTAINER AND INK JET CARTRIDGE

(75) Inventors: Nobuyuki Kuwabara, Tokyo (JP); Hiroyuki Ishinaga, Tokyo (JP); Tetsuya Ohashi, Chiba (JP); Ryoji Inoue, Kanagawa (JP); Hideki Ogura, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 161 days.

(21) Appl. No.: 10/671,619

(22) Filed: Sep. 29, 2003

(65) Prior Publication Data

US 2004/0061748 A1 Apr. 1, 2004

(30) Foreign Application Priority Data

Sep. 30, 2002 (JP) ..... 2002-287834

(51) Int. Cl.[7] ..... B41J 2/175
(52) U.S. Cl. ..... 347/85
(58) Field of Search ..... 347/84, 85, 86, 347/87

(56) References Cited

U.S. PATENT DOCUMENTS 4,967,207 A * 10/1990 Ruder ..... 347/7
5,481,289 A 1/1996 Arashima et al. ..... 347/93
5,854,646 A 12/1998 Barinaga et al. ..... 347/85
5,905,518 A * 5/1999 DeFilippis ..... 347/85
6,022,102 A * 2/2000 Ikkatai et al. ..... 347/85
6,234,615 B1 * 5/2001 Tsukuda ..... 347/85
6,264,312 B1 7/2001 Koitabashi et al. ..... 347/85
6,345,888 B1 2/2002 Matsumoto et al. ..... 347/86

(Continued)

FOREIGN PATENT DOCUMENTS

EP 803364 10/1997
EP 1190860 3/2002

(Continued)

*Primary Examiner*—Anh T. N. Vo
(74) *Attorney, Agent, or Firm*—Fitzpatrick, Cella, Harper & Scinto

(57) ABSTRACT

An ink supply system, an ink jet printing apparatus, an ink tank and an ink jet cartridge are provided which, in intermittently supplying ink through a disconnectable connecting portion, can smoothly supply a required volume of ink easily, and can quickly and smoothly discharge a gas which enters into the ink supply system without complicating their structure and mechanism. The first ink tank and the second ink tank are disconnectably connected through the supply unit and the connector. Two communication paths connecting the ink tanks are formed by the tubes. Gas in the second ink tank is discharged through one of the communication paths and at the same time ink in the first ink tank is supplied to the second ink tank through the other communication path.

20 Claims, 27 Drawing Sheets

U.S. PATENT DOCUMENTS

| | | | | |
|---|---|---|---|---|
| 6,474,796 | B1 | 11/2002 | Ishinaga | 347/85 |
| 6,505,923 | B1 * | 1/2003 | Yamamoto et al. | 347/85 |
| 6,520,630 | B1 * | 2/2003 | Oda et al. | 347/85 |
| 6,540,321 | B1 | 4/2003 | Hirano et al. | 347/22 |
| 6,722,761 | B2 * | 4/2004 | Asano et al. | 347/85 |
| 6,726,313 | B1 * | 4/2004 | Oda et al. | 347/85 |
| 6,773,099 | B2 * | 8/2004 | Inoue et al. | 347/86 |
| 6,802,601 | B2 * | 10/2004 | Suzuki et al. | 347/86 |
| 2003/0035036 | A1 | 2/2003 | Ogura et al. | 347/86 |
| 2003/0067518 | A1 | 4/2003 | Ishinaga et al. | 347/85 |
| 2003/0067520 | A1 | 4/2003 | Inoue et al. | 347/86 |
| 2003/0128256 | A1 | 7/2003 | Oda et al. | 347/85 |

FOREIGN PATENT DOCUMENTS

| | | | |
|---|---|---|---|
| EP | 1149706 | 7/2002 | |
| EP | 1231062 | 8/2002 | |
| JP | 58-194560 | 11/1983 | |
| JP | 2001-138541 | 5/2001 | JP |
| 2001-301194 | | 10/2001 | |

* cited by examiner

INK SUPPLY SYSTEM, INK JET PRINTING APPARATUS, INK CONTAINER, INK REFILLING CONTAINER AND INK JET CARTRIDGE

This application claims priority from Japanese Patent Application No. 2002-287834 filed Sep. 30, 2002, which is incorporated hereinto by reference.

BACKGROUND OF THE INVENTION

1. Field of the Invention

The present invention relates to an ink supply system for supplying ink through a connect portion that can be connected and disconnected, an ink jet printing apparatus, an ink container, an ink refilling container and an ink jet cartridge.

2. Description of the Related Art

Among printing apparatus that print an image on a print medium by applying ink from a print head onto a print medium, there is a serial scan type printing apparatus that applies ink from the print head onto the print medium while moving the print head. As the print head an ink jet print head which can eject ink toward the print medium may be used.

In general, the serial scan type printing apparatus using an ink jet print head print an image on a print medium by repetitively alternating two different operations, one that ejects ink from the print head onto the print medium while moving in a main scan direction the print head along with a carriage on which the print head is mounted and the other that feeds the print medium in a subscan direction crossing the main scan direction. The ink that the print head ejects is supplied from an ink tank.

One method of supplying ink to the print head involves mounting a large ink tank along with the print head on the carriage and supplying ink from the large ink tank to the print head. With this method, however, mounting the large ink tank on the carriage increases the weight of the carriage, making it difficult to stably drive the carriage in the main scan direction at high speed and leading to a possible increase in the size of a carriage drive system. Another ink supply method involves installing an ink tank at a predetermined position in the printing apparatus and supplying ink from the ink tank to the print head on the carriage through a flexible tube. This method also has a drawback that variations in carriage moving load and ink supply pressure resulting from deformations of the tube as the carriage moves may degrade a quality of a printed image.

The inventor of this invention previously proposed an apparatus that overcomes such drawbacks (Patent Reference 1).

The previously proposed apparatus has a relatively small subtank mounted on a carriage to supply ink to the print head and has a relatively large main tank installed at a certain position in the printing apparatus, with the ink being supplied from the main tank to the subtank when the carriage reaches a predetermined position. That is, when the carriage moves to the predetermined position, a joint on the main tank side and a joint on the subtank side are connected together to form an ink supply path and an ink recovery path between the main tank and the subtank. Then, the ink is delivered under pressure from the main tank through the ink supply path to the subtank until it overflows the subtank, with the overflowing ink returned along with air in the subtank to the main tank through the ink recovery path. After the subtank is supplied and overflowed with ink, the carriage is moved away from the predetermined position to disconnect the joint of the subtank from the joint of the main tank, thus disrupting the ink supply path and the ink recovery path.

Such a printing apparatus can eliminate drawbacks experienced with the conventional apparatus when a large ink tank is mounted on the carriage and when ink is supplied through a flexible tube.

Patent Reference 2 describes a construction in which two connect portions, first and second connect portions, are used to supply ink from a first ink container installed outside the carriage to a second ink container mounted on the carriage.

In this ink supply system a negative pressure generation mechanism using a capillary tube member is provided on the print head side. During a printing operation, external air (open air) is positively introduced from an atmosphere communication port on the print head side into the second ink container on the print head side. When an ink sensor provided on the print head side detects that a remaining ink in the second ink container is lower than a predetermined level, the carriage moves to a home position where a pump connected to the first connect portion discharges air from the second ink container and at the same time supplies ink from the first ink container connected to the second connect portion into the second ink container. That is, the first connect portion is situated higher in a gravity direction than, and the second connect portion is situated lower than, the second ink container on the carriage. The air in the second ink container is discharged by a suction means such as pump through the first connect portion and a resulting increase in a negative pressure in the second ink container draws ink from the first ink container into the second ink container through the second connect portion for ink refilling.

[Patent Reference 1]

Japanese Patent Application Laid-Open No. 58-194560 (1993)

[Patent Reference 2]

Japanese Patent Application Laying-open No. 2001-138541

With the above-proposed apparatus (Patent Reference 1), however, since the ink is supplied to the subtank until it overflows the subtank, the ink continues to be supplied after the subtank is full. Further, since it is necessary to recover the ink overflowing from the subtank, the printing apparatus is likely to become complex in construction and large in size.

The apparatus of the Patent Reference 2 also uses a suction produced by a pump in supplying ink, so its size may become large. Further, in this apparatus since air is actively introduced into the second ink container on the carriage during printing, when the ink in the second ink container is supplied continuously to the print head in a relatively large volume for printing, the air introduced into the second ink container may be drawn into the print head causing a printing failure. If such a trouble is to be avoided, an installation space between the negative pressure generation mechanism and the print head must be increased to prevent the air taken in from the negative pressure generation mechanism from being drawn into the print head. This puts limitations on their arrangements and sizes.

Further, the air in the second ink container on the carriage expands and contracts due to environmental variations such as ambient temperature and pressure changes causing pressure changes in the second ink container. Positive pressures as a result of pressure changes may cause ink leakage from nozzles of the print head. Conversely, excessive negative pressures may result in an improper ink ejection or a failure to eject ink. Therefore, in the construction of the apparatus of the cited Reference 2, it is necessary to increase the size of the capillary tube member, which also doubles as a buffer, to secure reliability. This hinders a reduction in the size of the print head. Increasing the size of the capillary tube member may lead to an increased size of the print head and a more complicated structure.

Further, if a means to forcibly move a gas out of the second ink container, such as a pump, is not used and particularly if the second ink container on the carriage is a hermetically closed system (i.e., if the second ink container excluding its connect portions for the first ink container and for the print head virtually forms a hermetically closed space), the gas in the second ink container cannot be removed but builds up in the second ink container. When a means such as pump to forcibly move a gas out of the second ink container is not used, even if the ink is supplied intermittently from the first ink container to the second ink container, the gas accumulated in the second ink container cannot be removed and will degrade an efficiency of ink refilling into the second ink container.

SUMMARY OF THE INVENTION

It is an object of the present invention to provide an ink supply system, an ink jet printing apparatus, an ink container, an ink refilling container and an ink jet cartridge which, when intermittently supplying ink through a disconnectable connect portion, can supply a predetermined volume of ink easily and smoothly.

Another object of the present invention is to provide an ink supply system, an ink jet printing apparatus, an ink container, an ink refilling container and an ink jet cartridge which can quickly and smoothly discharge a gas which enters into the ink supply system as ink is supplied intermittently from the ink container into the ink refilling container through disconnectable connect portions, without complicating their structure and mechanism.

In the first aspect of the present invention, there is provided an ink supply system comprising:

a first ink storage area to store ink; and a second ink storage area connected to the first ink storage area through a connecting means to introduce the ink from the first ink storage area for supply to a print head;

wherein the connecting means disconnectably connects the second ink storage area to the first ink storage area and, when the two ink storage areas are connected, forms a plurality of communication paths communicating the two ink storage areas with each other;

wherein the second ink storage area, excluding the plurality of communication paths and a connecting portion with the print head, virtually forms a hermetically closed space;

wherein, when the ink is refilled into the second ink storage area from the first ink storage area through at least one of the plurality of communication paths, a gas present in the second ink storage area can be transferred to the first ink storage area through at least one other communication path;

wherein the first ink storage area has a space to take in the gas transferred from the second ink storage area.

In the second aspect of the present invention, there is provided an ink jet printing apparatus for printing an image on a print medium by using an ink jet print head, the printing apparatus having an ink supply system defined above as a system to supply ink to the ink jet print head.

In the third aspect of the present invention, there is provided an ink container connected to an ink refilling portion through a connecting means to supply ink refilled from the ink refilling portion to a print head;

wherein the connecting means forms a plurality of communication paths which disconnectably connects the ink container to the ink refilling portion and, when the ink container is connected to the ink refilling portion, communicates them with each other;

wherein the ink container, excluding the plurality of communication paths and a connecting portion with the print head, virtually forms a hermetically closed space;

wherein, when the ink is refilled from the ink refilling portion to the ink container through at least one of the plurality of communication paths, a gas present in the ink container can be transferred to the ink refilling portion through at least one other communication path.

In the fourth aspect of the present invention, there is provided an ink jet cartridge comprising:

an ink container defined above; and an ink jet print head capable of ejecting ink supplied from the ink container.

In the fifth aspect of the present invention, there is provided an ink refilling container connected to an ink container through a connecting means to refill ink into the ink container, the ink container supplying ink to a print head, wherein the connecting means disconnectably connects the ink container to the ink refilling container and, when the ink container and the ink refilling container are connected, forms a plurality of communication paths communicating the ink container and the ink refilling container with each other;

wherein the ink container, excluding the plurality of communication paths and a connecting portion with the print head, virtually forms a hermetically closed space;

wherein, when the ink is refilled into the ink container from the ink refilling container through at least one of the plurality of communication paths, a gas present in the ink container can be transferred to the ink refilling container through at least one other communication path;

wherein the ink refilling container has a space to take in the gas transferred from the ink container.

In a system that intermittently supplies ink from the first ink tank (ink refilling container) to the second ink tank (ink container) through a disconnectable connecting portion, the construction of this invention can efficiently discharge gas from the second ink tank during the ink supply operation. Further, the gas in the second ink tank can be discharged out into the first ink tank and since the gas discharged into the first ink tank moves up, it is prevented from returning into the second ink tank. This can be explained by the principle described below.

When the second ink tank is connected to the first ink tank through a connecting means, a negative pressure in the second ink tank or a pressure difference resulting from a height difference between the first and second ink tanks causes ink to be drawn from the first ink tank into the second ink tank through at least one of a plurality of communication paths. As the ink refilling proceeds, the gas remaining in the second ink tank is discharged into the first ink tank through at least one other communication path. For example, when a wall of the second ink tank is formed of a flexible sheet or elastic member, the wall is moved in a direction that increases an inner volume of the second ink tank as the ink refilling proceeds. When the wall movement reaches its limit, the ink level in the second ink tank begins to rise, forcing the gas in the second ink tank out into the first ink tank. At this time, by placing an opening of at least one of the communication paths on the second ink tank side at a position higher than an opening of the other communication path, the at least one communication path continues to discharge the gas from the second ink tank out into the first ink tank even after the other communication path has submerged in the ink in the second ink tank. Therefore, the ink refilling operation accompanied by a gas discharge continues to be performed until the ink level in the second ink tank reaches the at least one communication path.

According to the present invention, in intermittently supplying ink from a first ink storage area to a second ink storage area through a disconnectable connection means, the present invention enables ink to be supplied efficiently into the second ink storage area while discharging a gas from the second ink storage area. Further, with this invention, the supply of ink accompanied by the discharge of gas can be implemented without using a driving power source such as a pump and no special time is needed for discharging the gas.

When the ink level in the second ink storage area reaches a position of the gas discharge communication path, the ink supply is automatically stopped. Thus, a required volume of ink to fill the second ink storage area full can be supplied to the second ink storage area.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Some preferred embodiments of the present invention as applied to an ink jet printing apparatus will be described with reference to the accompanying drawings.

In this specification, the word "printing or recording" means forming images and patterns, including significant information such as characters and figures, on a print medium or processing the print medium, whether the information printed is significant or nonsignificant or whether it is latent or visible to human sight.

The word "print medium" refers to not only paper generally used in printing apparatus but also materials that can accept ink, such as cloth, plastic film, metal plate, glass, ceramics, wood and leather. In the following the print medium may also be referred to as sprint paper or simply "paper."

Further, in a field of ink jet printing, the present invention can also supply a process liquid for the print medium in the same way as the ink.

(First Embodiment)

[Outline Construction of Printing Apparatus]

Figure 1:
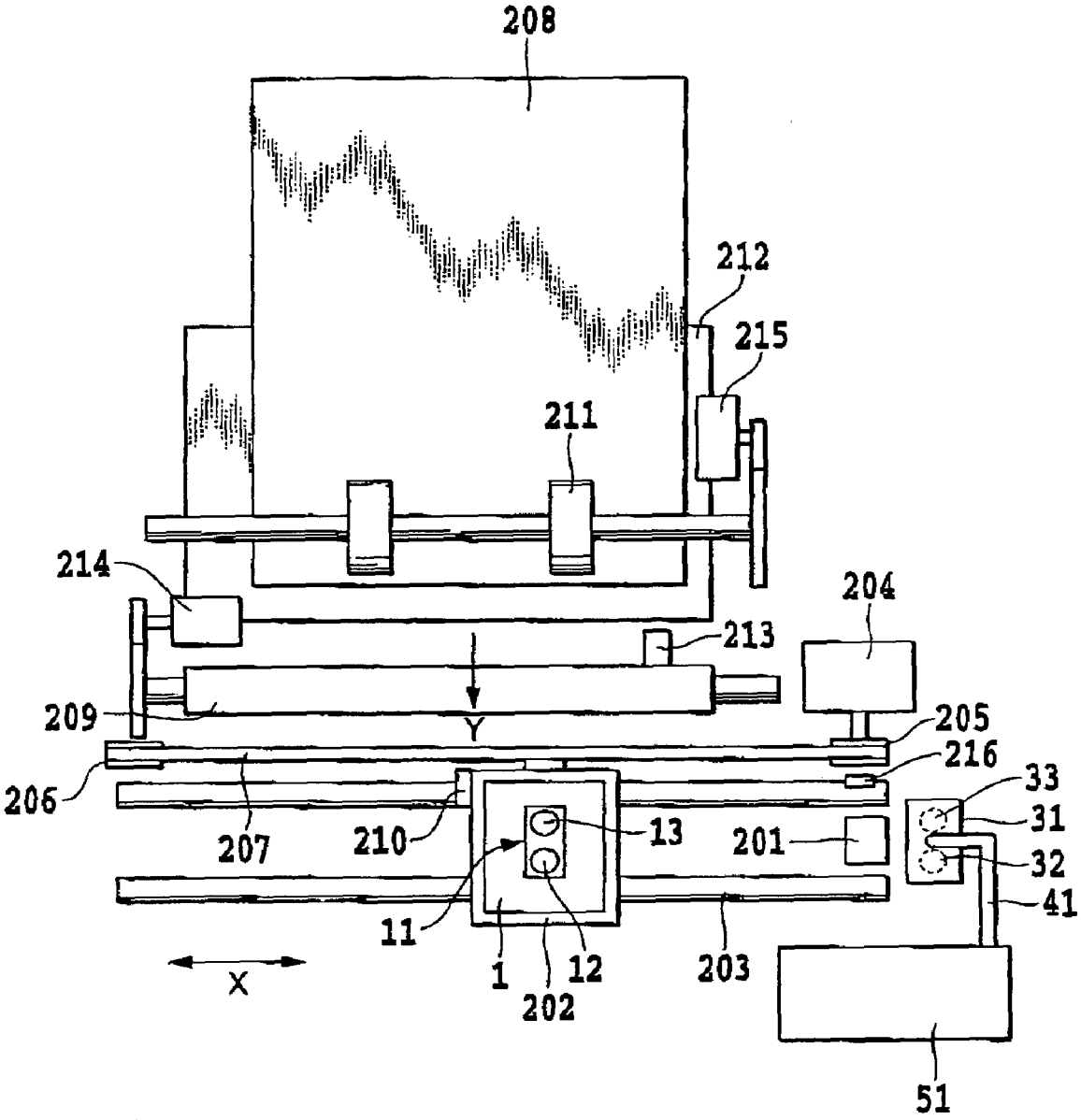
FIG. 1 is a schematic plan view showing essential portions of an ink jet printing apparatus in a first embodiment of the present invention.

FIG. 1 is a schematic plan view showing an outline construction of an ink jet printing apparatus as a first embodiment of the present invention.

In FIG. 1 an ink jet cartridge (hereinafter referred to as a "head unit") 1 is positioned and replaceably mounted on a carriage 202. The head unit 1 has an ink jet print head, a second ink tank connected to the print head and two tubes 12, 13 communicating with the second ink tank. One of the tubes 12 is called an ink introducing tube because it has a function of mainly introducing ink into the second ink tank. The other tube 13 is called a gas discharge tube as it has a function of mainly discharging air from the second ink tank. However, as described later, the ink introduction and air discharging are each performed by both of these tubes 12, 13. Hence, their names do not mean that they are dedicated to either ink introduction or air discharging function. The second ink tank and the two tubes 12, 13 combine to form a second ink storage area. The ink jet print head is provided with an electric connecting portion (connector) that transmits a drive signal to each ink ejection portion or nozzle through an external signal input terminal. The carriage 202 has a connector holder for transmitting the drive signal to the connector.

The carriage 202 is guided on a guide shaft 203 installed in the apparatus body so that it is reciprocally movable in a main scan direction indicated by an arrow X. The carriage 202 is driven by a main scan motor 204 through a drive mechanism, including a motor pulley 205, a follower pulley 206 and a timing belt 207, to control its position and movement. The carriage 202 also has a home position sensor 210, and a shielding plate 216 is installed at a predetermined position in the apparatus body. When the home position sensor 210 on the carriage 202 moves past the shielding plate 216, it determines that the carriage 202 is at the home position. It is also possible to determine the position of the carriage 202 by using the home position as a reference position.

Print media 208 such as print paper and plastic sheets are picked up and fed downward in FIG. 1 one by one from an auto sheet feeder (ASF) 212 by operating a feed motor 215 to rotate a pickup roller 211 through gears. The print medium 208 is further fed in a subscan direction indicated by an arrow Y by the rotation of a transport roller 209 to move past a printing position facing a nozzle-arrayed face of the print head of the head unit 1. The transport roller 209 is rotated by an LF motor 214 through gears. A decision on whether the print medium 208 has been fed and a determination of a front end position of the print medium 208 during paper feeding are conducted when the print medium 208 passes the position of a paper end sensor 213. The paper end sensor 213 is also used to detect a rear end position of the print medium 208 to calculate a current printing position on the print medium 208 based on the rear end position detected.

The print medium 208 is supported at its back on a platen (not shown) so that it forms a flat surface at the printing position. The head unit 1 is held in the carriage 202 so that the nozzle-arrayed face of the print head protruding downward from the carriage 202 is parallel to the print medium 208 at the printing position.

The head unit 1 is mounted on the carriage 202 so that the direction of an array of nozzles in the front face of the print head crosses the main scan direction X. The head unit 1 ejects ink droplets from the array of nozzles in the print head onto the print medium 208 to form an image.

Designated 201 is a recovery mechanism which has a cap member to suck out ink from the nozzles of the print head of the head unit 1 and to protect the array of nozzles. This cap member is driven by a motor not shown to be brought into or out of hermetic contact with the nozzle array. The cap member is generally formed of rubber to ensure a sufficiently airtight seal between the nozzle array and the cap member when the cap member is pressed against the face of the print head. With the cap member hermetically enclosing the nozzle array, the inside of the cap member is evacuated by a suction pump to draw ink from the nozzles of the print head out into the cap member. In this way the suction-based recovery operation is performed. If the suction pump is not operated with the cap member pressed against the print head face, the cap member serves to protect the nozzles when the printing apparatus is not in use.

Figure 2:
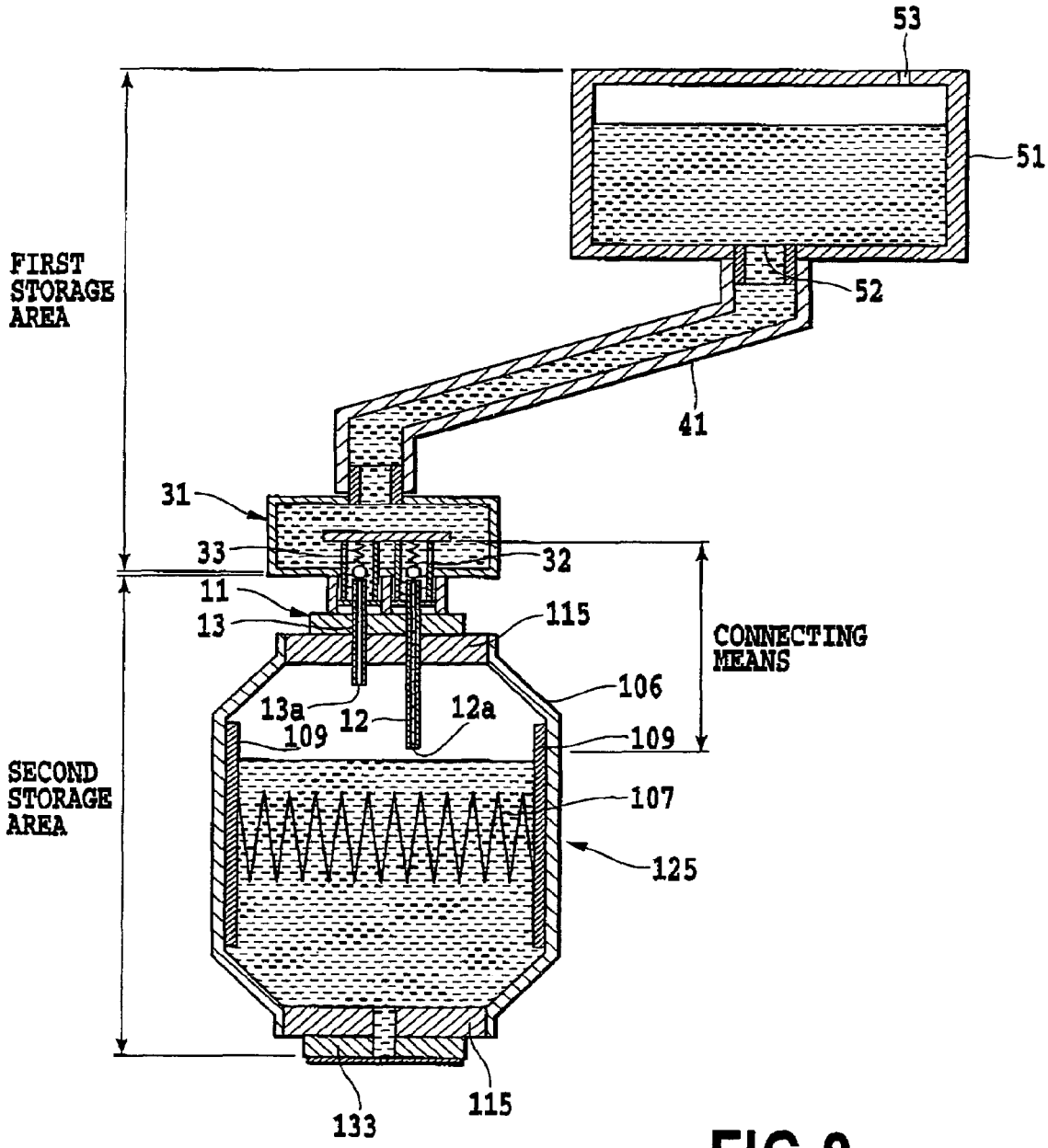
FIG. 2 is a cross-sectional view showing an outline construction of an ink supply system used in the ink jet printing apparatus of FIG. 1.

Denoted 11 is a connector which connects a second ink tank 125 (see FIG. 2) in the head unit 1 with a first ink tank 51 (see FIG. 2) to refill the second ink tank 125 and discharge air from the same tank 125. The connector 11 is attached with an ink introducing tube 12 and a gas discharge tube 13. Further, the connector 11 is provided on that surface of the head unit 1 which is situated at the top of the unit 1 during the use of the printing apparatus. When the carriage 202 moves to the home position, the connector 11 is connected to a supply unit 31 (see FIG. 2) installed in the ink jet printing apparatus. As shown in FIG. 2, the supply unit 31 has an ink supply tube 32 and a gas extraction tube 33 which connect to the ink introducing tube 12 and the gas discharge tube 13, respectively. Further, the supply unit 31 is connected to the first ink tank 51 through an ink path 41. The ink path 41 is formed by a hollow tube that connects an upper part of the supply unit 31, situated above the tube during the operation of the printing apparatus, and a lower part of the first ink tank 51, situated below the tube during the operation. The first ink tank 51, the ink path 41 and the supply unit 31 combine to form a first ink storage area.

Figure 4A:
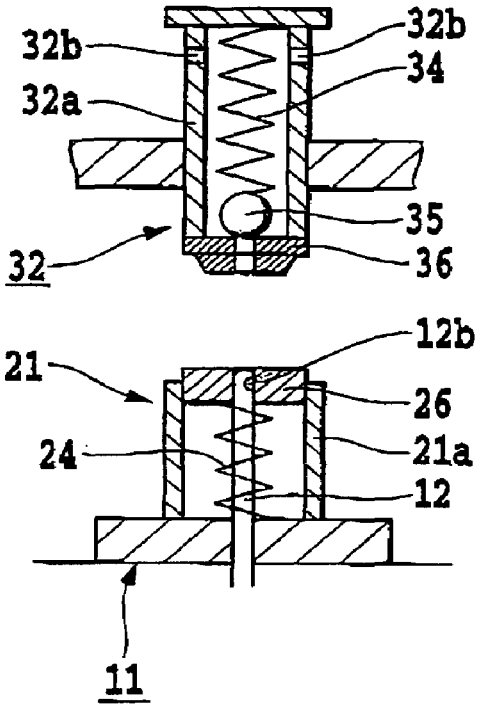
FIGS. 4A and 4B are cross-sectional views showing a connecting portion of the connector in the ink supply system of FIG. 2 in disconnected and connected states.
Figure 4B:
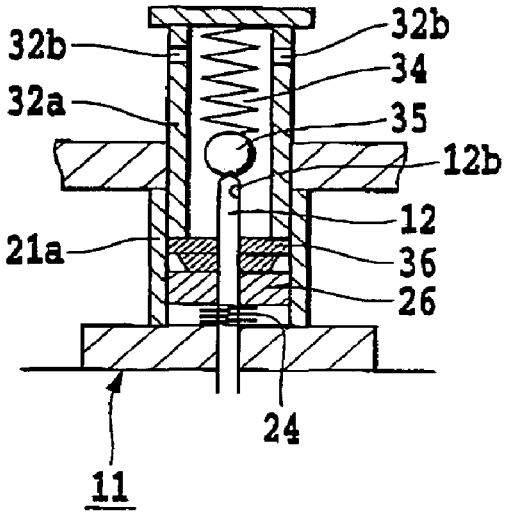

FIG. 4A and FIG. 4B are explanatory views showing example constructions of the connector 11 and the supply unit 31.

These figures show a construction of an ink introducing portion 21 of the connector 11 including the ink introducing tube 12 and a construction of the ink supply tube 32 of the supply unit 31 connected to the ink introducing portion 21. These constructions also apply to those of the gas discharge portion of the connector 11 including the gas discharge tube 13 and of the gas extraction tube 33 of the supply unit 31 connected to the gas discharge portion.

As shown in FIG. 4A, the ink supply tube 32 of the supply unit 31 has a cylindrical base member 32*a* in which a ball 35 and a spring 34 that urges the ball 35 against a rubber 36 are provided. The rubber 36 is attached to one end of the base member 32*a* and formed with a slit. An upper part of the base member 32*a* is formed with holes 32*b* that communicate the interior of the base member 32*a* to an ink storage space in the supply unit 31. Ink that flowed from the first ink tank 51 through the ink path 41 and the holes 32*b* into the ink supply tube 32 of the supply unit 31 enters the base member 32*a*. In the disconnected state shown in FIG. 4A, the ball 35 closes the slit in the rubber 36, so the ink is prevented from leaking out from the ink supply tube 32. The ink introducing portion 21 has a seal rubber 26 slidable inside a base member 21*a*, an ink introducing tube 12 installed so as to pass through a center hole in the seal rubber 26, and a spring 24 urging the seal rubber 26 upward in the figure. The ink introducing tube 12 is hollow and pointed at its front end like a needle with a hole 12*b* formed in a side of the front end. The hollow ink introducing tube 12 communicates at its lower end with the interior of the second ink tank 125 and also with an outside through the hole 12*b*. The hole 12*b* is closed by the seal rubber 26 in the disconnected state of FIG. 4A.

When the carriage 202 moves to the home position, the ink supply tube 32 and the ink introducing tube 12 of the above construction are connected together as shown in FIG. 4B. That is, the base member 32*a* of the ink supply tube 32 enters into the base member 21*a* of the ink introducing portion 21, pushing down the seal rubber 26 against the force of the spring 24. This causes the front end of the ink introducing tube 12 inside the ink introducing portion 21 to pass through the slit in the rubber 36 and push up the ball 35 in the base member 32*a* against the force of the spring 34. As a result, the hole 12*b* of the ink introducing tube 12 is open inside the base member 32*a*, communicating the first ink tank 51 and the second ink tank 125 through the holes 32*b*.

[Structure and Manufacturing Method of Second Ink Tank]

Referring to FIGS. 8 to 14, an example of structure and manufacturing method of the second ink tank 125 will be described.

Figure 8:
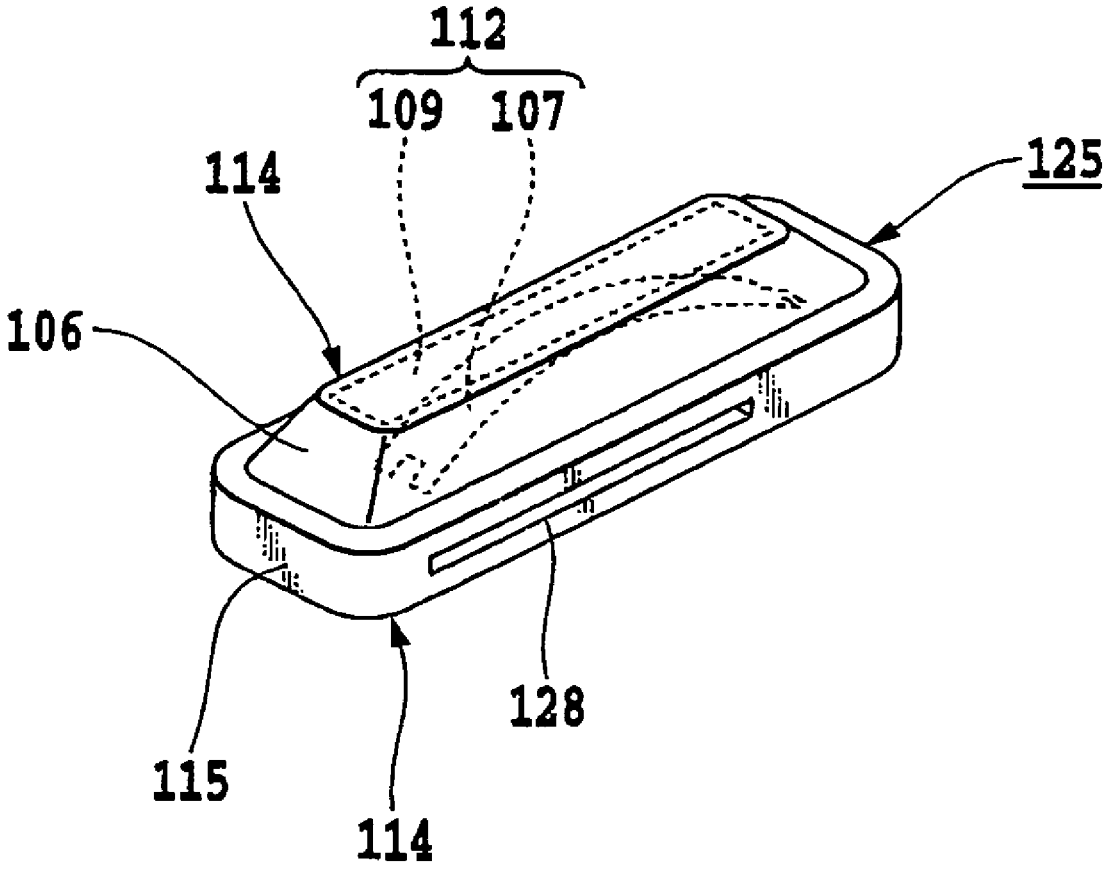
FIG. 8 is a perspective view of a second ink tank according to the present invention.

FIG. 8 is a perspective view of an second ink tank 125 manufactured through steps as described below, the tank having an enclosed structure in which top and bottom spring/sheet units 114 are mounted to openings at the top and bottom of a square frame 115 As will be described later, the spring/sheet unit 114 is constituted by a spring unit 112 including a spring 107 and a pressure plate 109 and a flexible tank sheet 106. The frame 115 is formed with an ink supply port 128 for supplying an ink in the second ink tank 125 to an ink jet print head, a setting port (not shown) for setting the ink introducing tube 12, and a setting port (not shown) for setting the gas discharge tube 13.

Figure 9A:
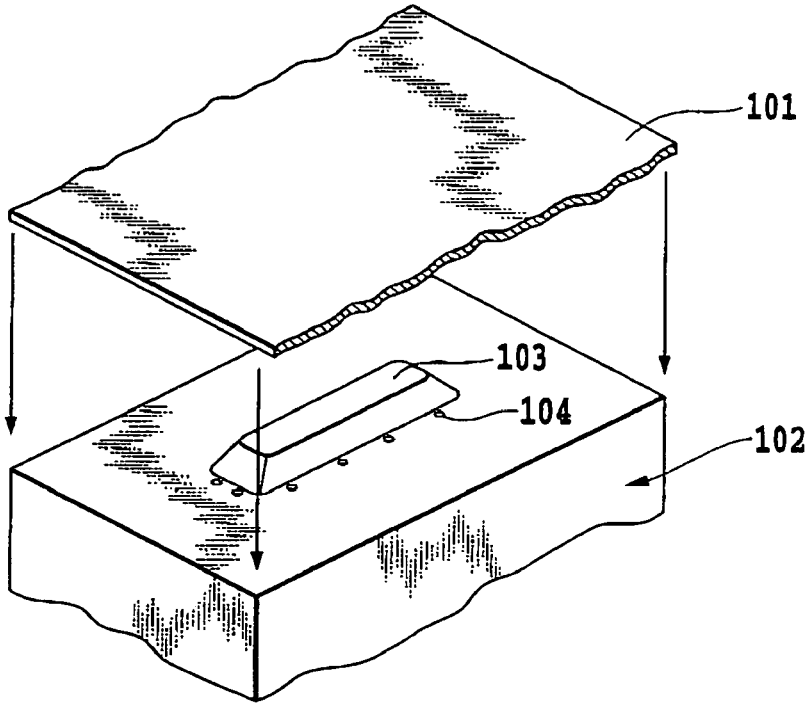
FIGS. 9A, 9B and 9C are explanatory diagrams showing how a tank sheet of the ink tank of FIG. 8 is formed.

FIGS. 9A to 13B illustrate a method of manufacturing such second ink tank 125. First, FIGS. 9A, 9B, and 9C are illustrations of steps of forming the flexible tank sheet 106 with a convex shape.

A sheet material 101 for forming the tank sheet 106 is formed from a raw material into a sheet having a large size, and the sheet material 101 is an important factor of the performance of the second ink tank 125. The sheet material 101 has low permeability against gases and ink components, flexibility, and durability against repeated deformation. Such preferable materials include PP, PE, PVDC, EVOH, nylon, and composite materials with deposited aluminum, silica or the like. It is also possible to use such materials by laminating them. In particular, excellent ink tank performance can be achieved by laminating PP or PE that has high chemical resistance and PVDC, EVOH that exhibits high performance in blocking gases and vapors. The thickness of such a sheet material 101 is preferably in the range from about 10 $\mu$m to 100 $\mu$m taking softness and durability into consideration.

Figure 9B:
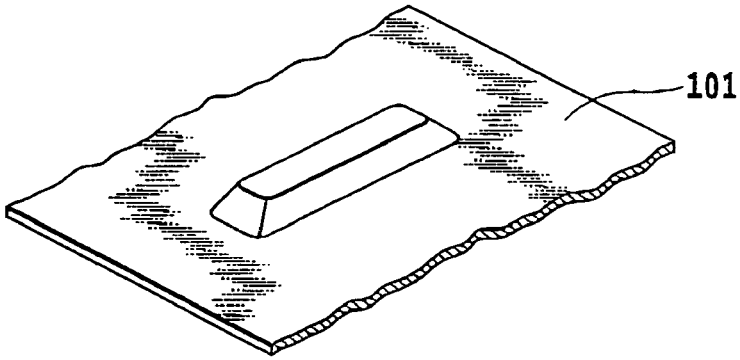
Figure 9C:
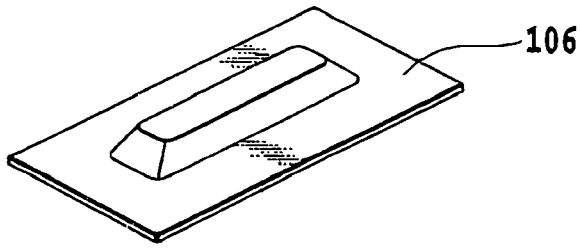

As shown in FIG. 9A, such a sheet material 101 is formed into a convex shape using a forming die 102 having a convex portion 103, a vacuum hole 104, and a temperature adjusting mechanism (not shown). The sheet material 101 is absorbed by the vacuum hole 104 and formed into a convex shape that is compliant with the convex portion 103 by heat from the forming die 102. After being formed into the convex shape as shown in FIG. 9B, the sheet material 101 is cut into a tank sheet 106 having a predetermined size as shown in FIG. 9C. The size is only required to be suitable for manufacturing apparatus at subsequent steps and may be set in accordance with the volume of the second ink tank 125 for containing ink.

Figure 10A:
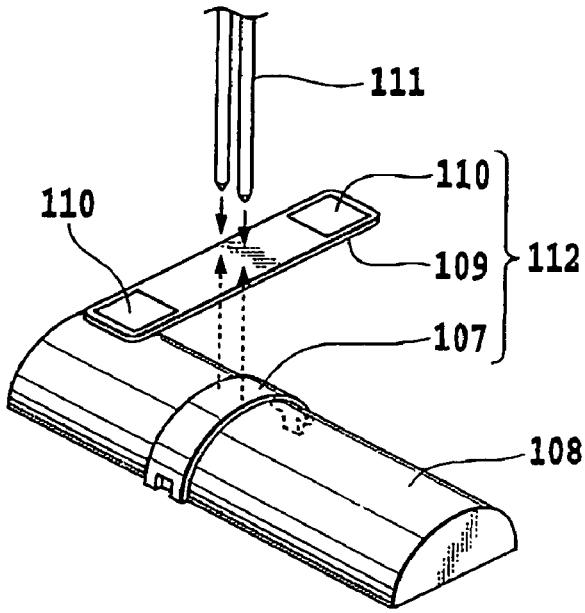
FIG. 10A illustrates a process of manufacturing a spring unit in the ink tank of FIG. 8.

FIG. 10A is an illustration of a step of manufacturing the spring unit 112 used for generating a negative pressure in the second ink tank 125. A spring 107 that is formed in a semicircular configuration in advance is mounted on a spring receiving jig 108, and a pressure plate 109 is attached to the same from above through spot welding using a welding electrode 111. A thermal adhesive 110 is applied to the pressure plate 109. A spring unit 112 is constituted by the spring 107 and the pressure plate 109.

Figure 10B:
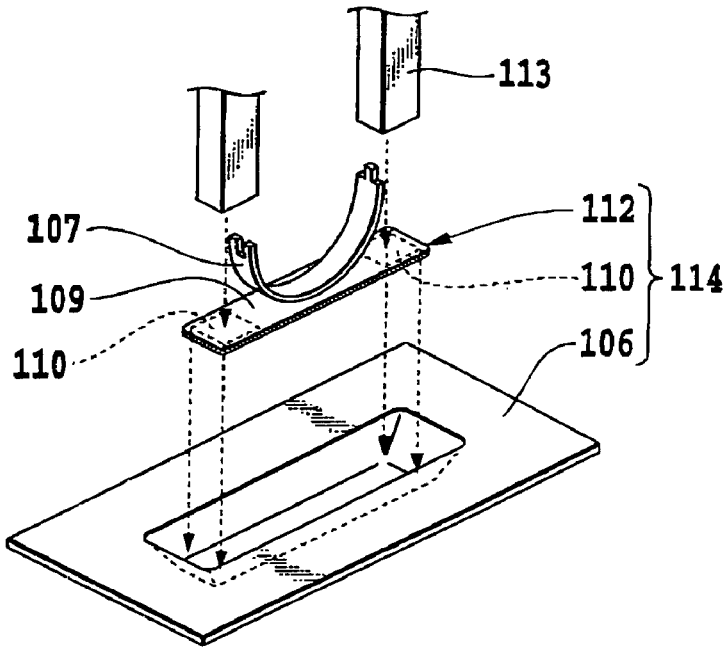
FIG. 10B illustrates a process of manufacturing a spring/seat unit in the ink tank of FIG. 8.

FIG. 10B is an illustration of a step of mounting a spring unit 112 to the tank sheet 106. The spring unit 112 is positioned on an inner surface of the tank sheet 106 placed on a receiving jig (not shown). The thermal adhesive 110 is heated using a heat head 113 to bond the spring unit 112 and the tank sheet 106 to form a spring/sheet unit 114.

Figure 11A:
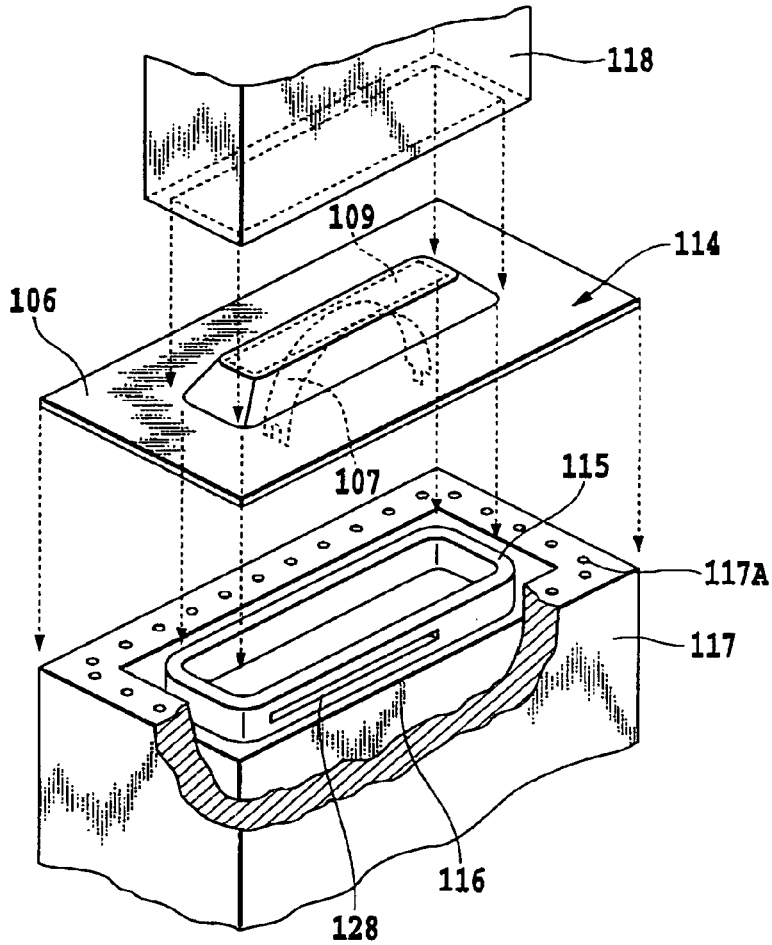
FIGS. 11A and 11B illustrate a process of manufacturing a spring/seat/frame unit in the ink tank of FIG. 8.

FIG. 11A is an illustration of a step of welding the spring/sheet unit 114 to the frame 115. The frame 115 is secured to a frame receiving jig 116. After the flame 115 is positioned and placed on the jig 116, a sheet absorbing jig 117 surrounding the frame 115 absorbs the spring/sheet unit 114 to a vacuum hole 117A to hold the unit 114 and the frame 115 without relative misalignment. Thereafter, a heat head 118 is used to thermally weld annular joint surfaces of a top side circumferential edge of the frame 115 and a circumferential edge of the tank sheet 106 of the spring/sheet unit 114 in the figure. Since the sheet absorbing jig 117 sets the top circumferential edge of the frame 115 in FIG. 11A and the circumferential edge of the tank sheet 106 of the spring/sheet unit 114 in a uniform face-to-face relationship, the bonding surfaces are quite uniformly thermally welded and sealed. Therefore, the sheet absorbing jig 117 is important for thermal welding in order to provide uniform sealing.

Figure 11B:
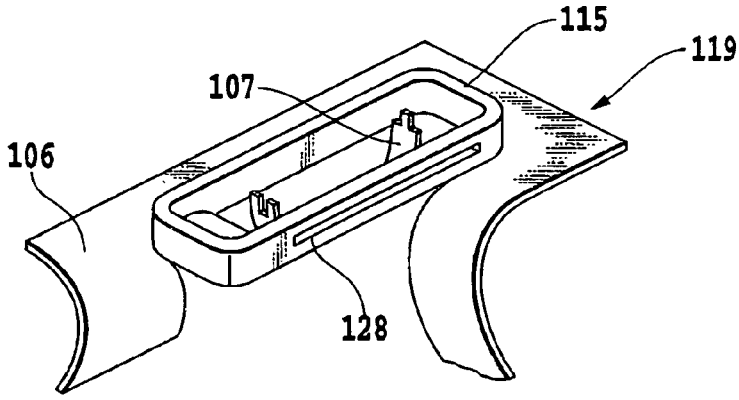

FIG. 11B is an illustration of a step of cutting off a part of the tank sheet 106 protruding from the frame 115 with a cutter (not shown). A spring/sheet/frame unit 119 is completed by cutting off the part of the tank sheet 106 protruding from the frame 115.

Figure 12:
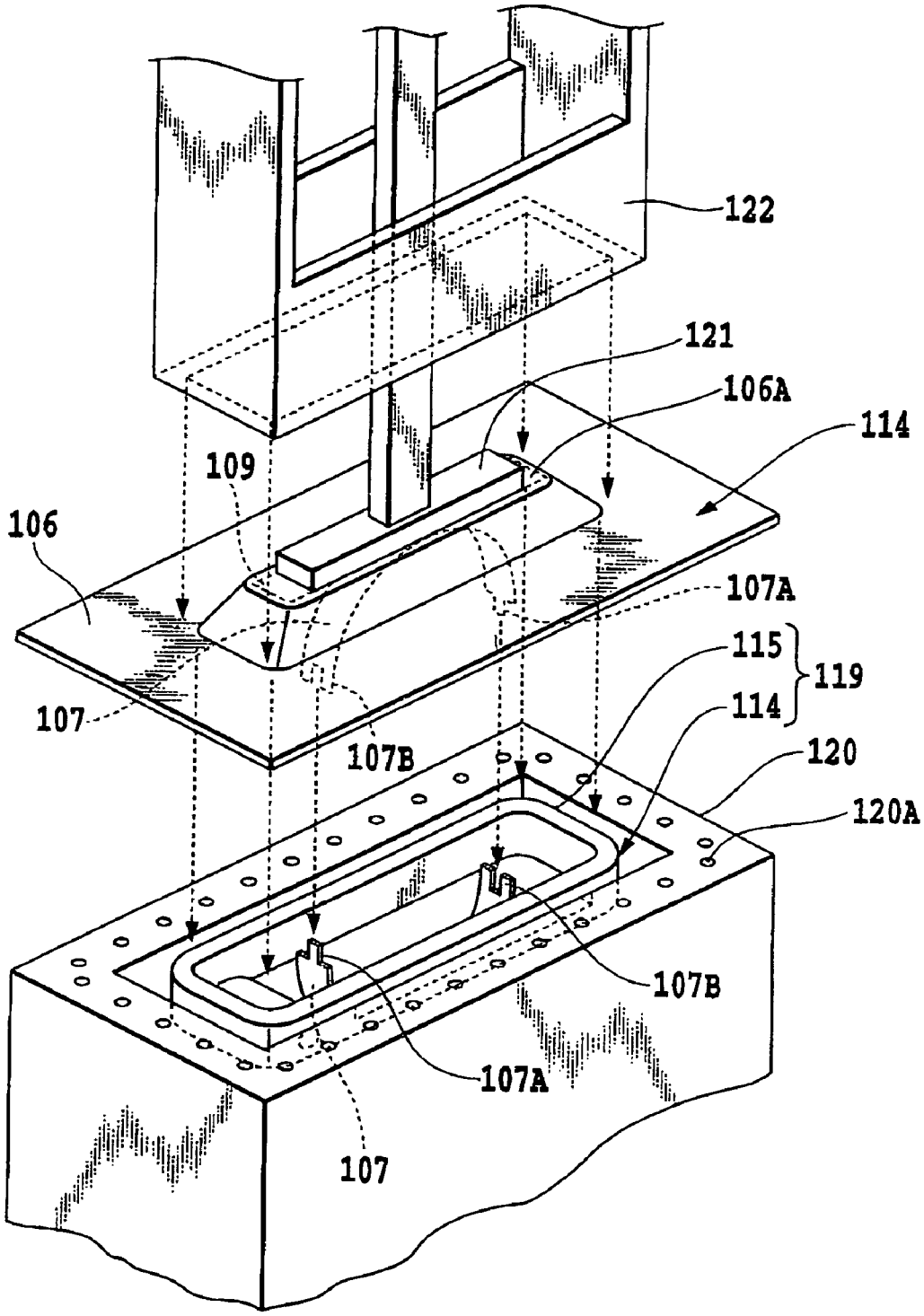
FIG. 12 illustrates a process of combining the spring/seat unit and the spring/seat/frame unit in the ink tank of FIG. 8.
Figure 13A:
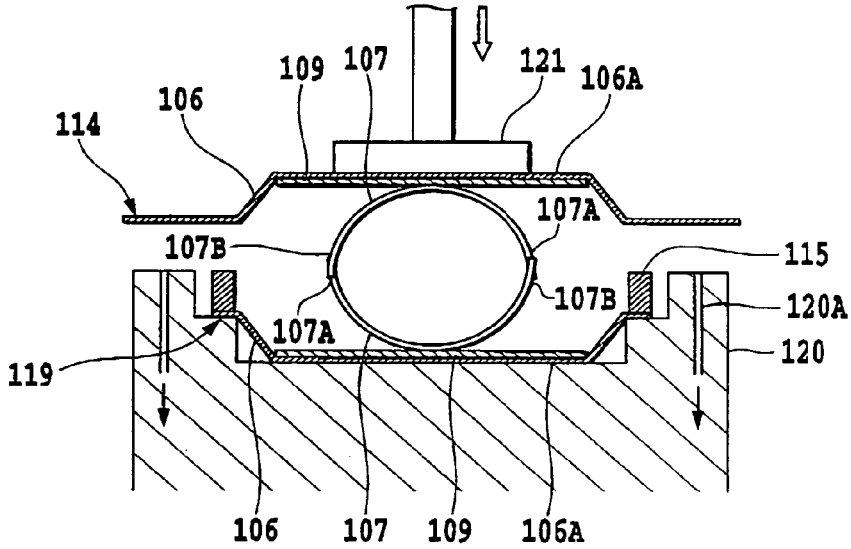
FIGS. 13A and 13B are cross-sectional views of essential portions in the combining process of FIG. 12.
Figure 13B:
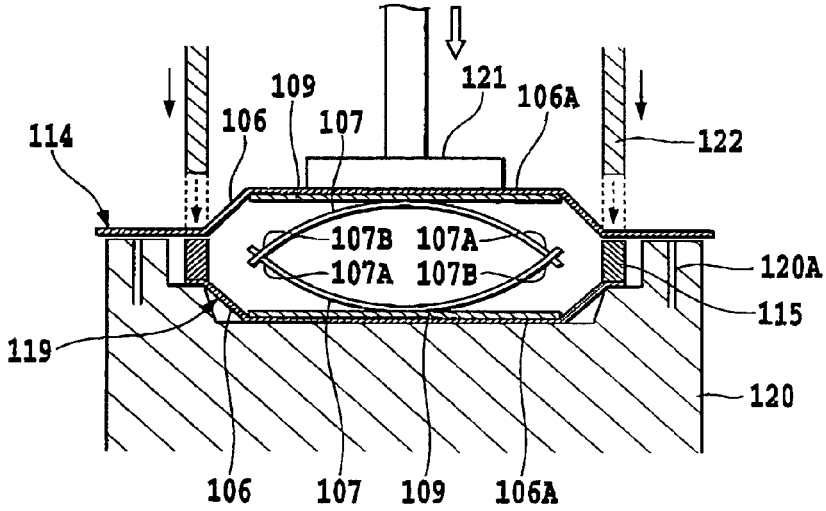

FIG. 12, FIG. 13A, and FIG. 13B are illustrations of steps of thermally welding another spring/sheet unit 114 fabricated through the above-described steps to such a spring/sheet/frame unit 119. As shown in FIG. 12, the spring/sheet/frame unit 119 is mounted on a receiving jig (not shown), and the periphery of the spring/sheet/frame unit 119 is surrounded by an absorbing jig 120 whose position is defined relative to the receiving jig. The receiving jig is in surface contact with an outer planar section 106A of the tank sheet 106 of the spring/sheet/frame unit 119 to hold the planar section 106A as shown in FIGS. 13A and 13B. The other spring/sheet unit 114 is absorbed and held by a holding jig 121 at an outer planar section 106A of the tank sheet 106 thereof, and the holding jig 121 is lowered to fit ends 107A and 107B of the spring 107 of the spring/sheet unit 114 and ends 107A and 107B of the spring 107 of the spring/sheet/frame unit 119 substantially simultaneously. The ends 107A of the springs 107 have a convex shape, and the other ends 107B have a concave shape, which causes them to fit each other respectively an a self-alignment basis. A single spring member is formed by combining those springs 107 as a pair of spring member forming bodies.

The holding jig 121 is further lowered to compress the pair of springs 107 as shown in FIG. 13A. In doing so, the holding jig 121 widely presses the top planar section 106A of the spring/sheet unit 114 in FIG. 13A, i.e., a top flat region of the tank sheet 106 that is formed in a convex configuration. As a result, the position of the planar section 106A of the tank sheet 106 is regulated, and the spring/sheet unit 114 approaches the unit 119 and the jig 120 located below the same while being kept in parallel with them. Therefore, as shown in FIG. 13B, the circumferential edge of the tank sheet 106 of the spring/sheet unit 114 is absorbed and held at the vacuum hole 120A in contact with a surface of the absorbing jig 120, and it is also put in a uniform face-to-face relationship with the welding surface (the top joint surface in the same figure) of the frame 115. In this state, the annular joint surfaces of the top circumferential edge of the frame 115 of the spring/sheet/frame unit 119 and the tank sheet 106 of the spring/sheet unit 114 are thermally welded to each other with a heat head 122.

By compressing the pair of springs 107 while thus maintaining parallelism between the planar section 106A of the tank sheet 106 of the upper unit 114 and the planar section 106A of the tank sheet 106 of the lower unit 119, the second ink tanks 125 having high parallelism between the planar sections 106A of the pair of tank sheets 106 thereof can be produced on a mass production basis with stability. Since the pair of springs 107 are symmetrically and uniformly compressed and deformed in FIGS. 13A and 13B, there will be no force that can incline the spring/sheet unit 114, which makes it possible to produce the second ink tanks 125 having high parallelism between the planar sections 106A of the pair of tank sheets 106 thereof with higher stability. Further, since the pair of springs 107 are symmetrically and uniformly compressed and deformed in FIGS. 13A and 13B, the interval between the planar sections 106A of the pair of tank sheets 106 in a face-to-face relationship changes with higher parallelism maintained, which consequently makes it possible to supply ink with stability. Further, the second ink tank 125 has high sealing property, pressure resistance, and durability because no force acts to incline the planar section 106A of the flexible tank sheet 106.

Thereafter, the part of the tank sheet 106 protruding from the frame 115 is cut off to complete the second ink tank 125 as shown in FIG. 8. The interior of the second ink tank 125 has an enclosed structure that is in communication with the outside only through the ink supply port 128, the setting port (insert port) for setting the ink introducing tube 12, and a setting port (insert port) for setting the gas discharge tube 13.

Figure 14:
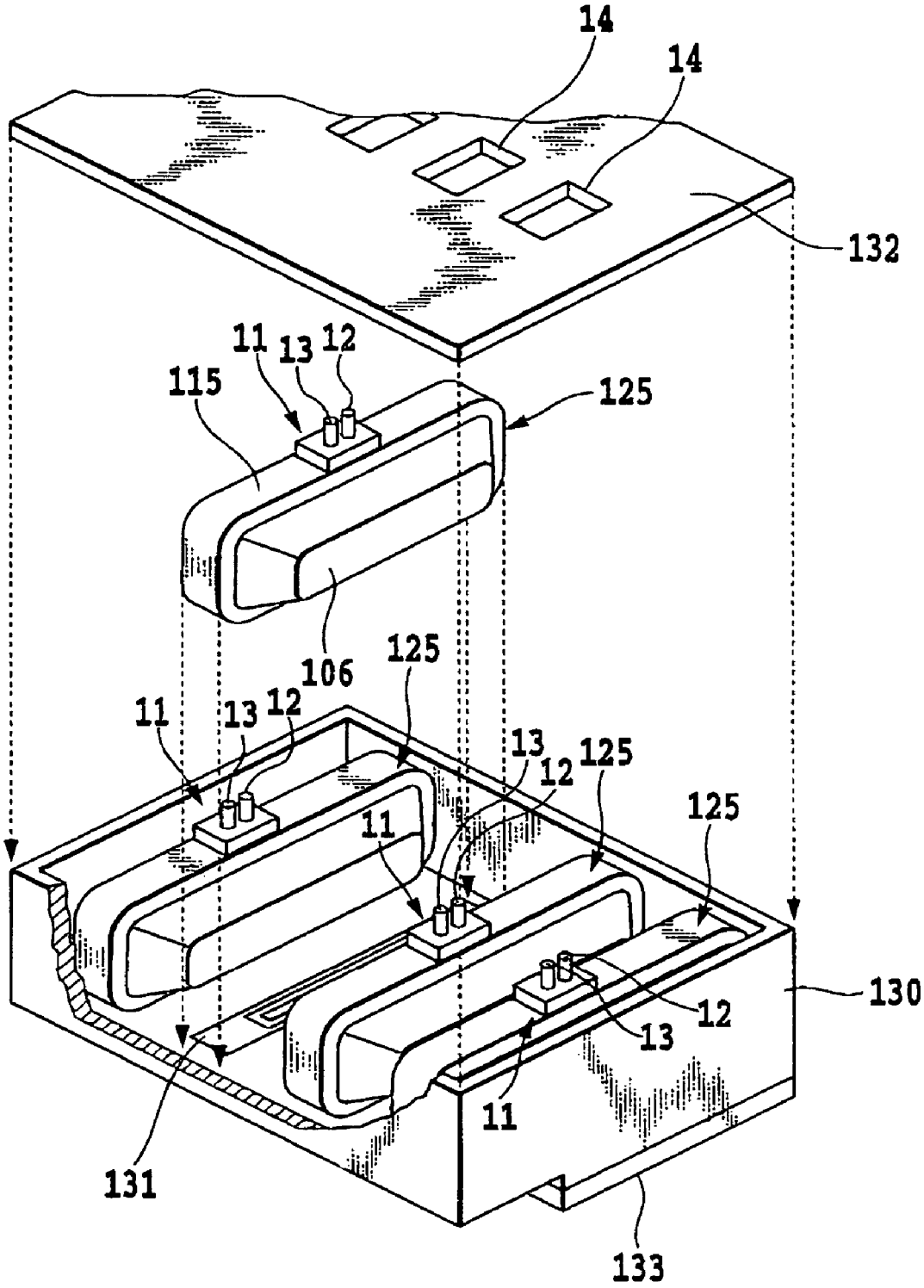
FIG. 14 illustrates a process of mounting the ink tank of FIG. 8.

FIG. 14 is an illustration of a step of mounting the second ink tank 125 to the print head. A head chip 133 serving as the print head is mounted in an ink tank containing chamber 130, and a plurality of second ink tanks 125 are mounted in the ink tank containing chamber 130. The second ink tanks 125 are mounted to an ink tank mounting section 131 using welding or bonding. The second ink tanks 125 of the present embodiment are mounted with the connector 11 located on the bottom thereof. Thereafter, a lid 132 is mounted to an opening of the ink tank containing chamber 130 using welding or bonding to form a semi-enclosed space in the ink tank containing chamber 130. A plurality of openings 14 are formed at the portions of the lid 132 facing the each connector 11 so that the connectors 11 mounted on the upper face of the second ink tank 125 are extended upward from the lid 132. The head chip 133 may serve as an ink jet print head. The ink jet print head may have a configuration in which an electrothermal transducer is provided to eject ink droplets from an ink ejection port, for example. Specifically, a configuration may be employed in which film boiling of ink is caused by heat generated by the electrothermal transducer and in which ink droplets are ejected from the ink ejection port utilizing the foaming energy. A head unit 1 can be configured by combining such an ink jet print head and the second ink tank 125.

Figure 15:
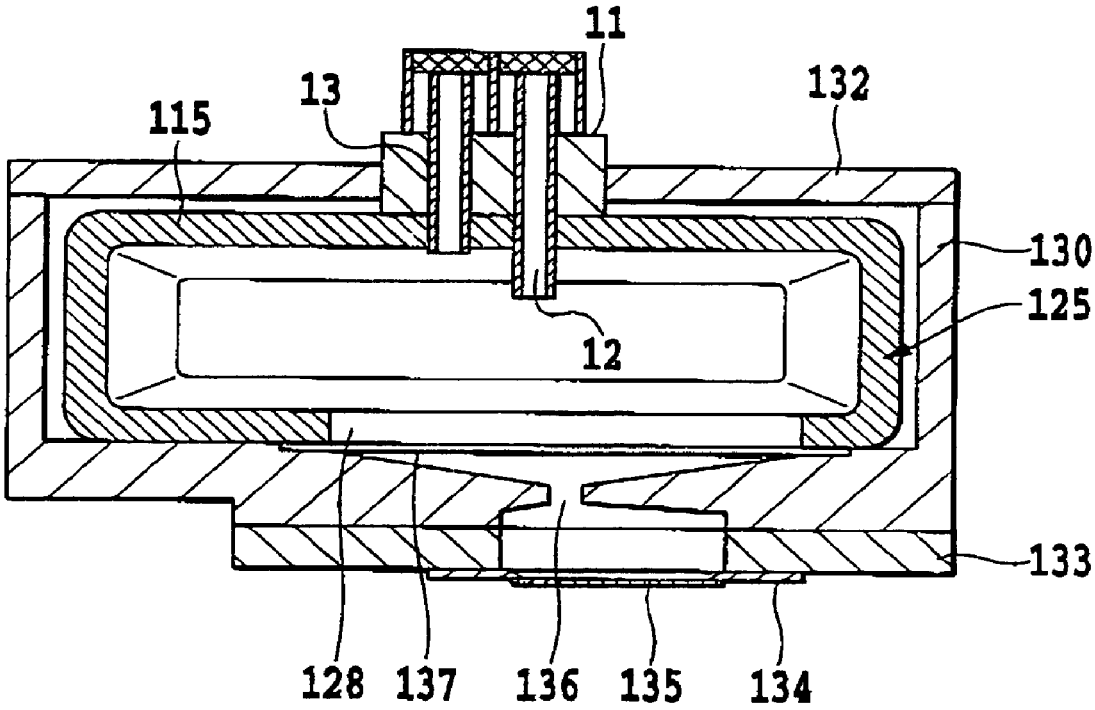
FIG. 15 is a cross-sectional view showing essential portions of the ink tank of FIG. 14 in the mounted state.

FIG. 15 is a cross-sectional view of the head unit 1 mounting the second ink tank 125 described above.

The second ink tank 125 can accommodate ink and be refilled with it. The ink is delivered from an ink supply port 128 of the second ink tank 125 through a filter 137 to a supply path 136, from which it is further supplied to a head chip 133. The head chip 133 in this embodiment is bonded with a heater board 134 to construct an ink jet print head. The heater board 134 is formed with ink ejection paths and orifices and also has electrothermal transducers (heaters). This construction allows the ink supplied from the second ink tank 125 to be ejected from the print head.

The second ink tank 125 can be refilled with ink mainly through the ink introducing tube 12 attached to the connector 11. The ink introducing tube 12 is securely bonded to a rectangular-shaped frame 115 to prevent a possible ink leakage from the outside of the ink introducing tube 12. Similarly, the gas discharge tube 13 is also securely bonded to the rectangular-shaped frame 115. The second ink tank 125 is refilled with ink by connecting the connector 11 situated at the top of the gas discharge tube 13 to the supply unit 31 installed in the printing apparatus. The connecting process will be described in detail.

Paired springs 107 in the second ink tank 125 may be replaced with a single spring that has a similar construction to that of the paired springs when combined. In that case, the single spring may be attached to one of paired tank sheets 106, which is then secured to the frame 115. The other tank sheet 106 may then be secured to the frame 115 by compressing the single spring. It is also possible to simply hold the single spring between the paired tank sheets 106, rather than securing the single spring to one of the paired tank sheets 106. At least one of the paired tank sheets 106 need be formed of a flexible member.

[Ink Refilling Operation]

Next, a sequence of operation in refilling the second ink tank 125 of the head unit 1 with ink and at the same time discharging a gas from the second ink tank 125 will be explained.

FIG. 2 shows one of a plurality of second ink tanks 125, with the connector 11 of the second ink tank 125 connected with the supply unit 31 of the first ink tank 51. As shown in FIG. 2, an area from the first ink tank 51 to the ink path 41 to the supply unit 31 may be defined as a first ink storage area, an area from the ink introducing tube 12 and gas discharge tube 13 to the head chip 133 as a second ink storage area, and an area from the ink supply tube 32 and gas extraction tube 33 to the ink introducing tube 12 and gas discharge tube 13 as a connecting means.

The first ink tank 51 accommodates ink in a molded container formed with an ink extraction port 52 at its bottom and an open air communication port 53 at its top. Since the first ink tank 51 is situated higher than the second ink tank 125, the connecting ink path 41 is inclined.

The open air communication port 53 in the first ink tank 51 introduces air into the first ink tank 51 as the ink is delivered from the first ink tank 51 and the ink volume in it decreases. This keeps the pressure in the first ink tank 51 at an atmosphere, assuring a smooth ink delivery. Thus, the open air communication port 53 needs only to be open at least after the ink begins to be consumed, i.e., after the first ink tank 51 is mounted in the printing apparatus. Therefore, the open air communication port 53 may be closed by a seal member before the first ink tank 51 is mounted in the printing apparatus. Closing the open air communication port 53 until the first ink tank 51 is mounted is conducive to preventing an ink leakage and evaporation from the container prior to the use of the first ink tank 51. Opening the open air communication port 53 for the use of the ink tank can be accomplished by the user peeling a seal off or puncturing it with a needle just before mounting the ink tank in the printing apparatus.

While in this embodiment the first ink tank has been described to be a molded container, it may be formed of a baglike flexible sheet. In that case, since the sheet bag can be deformed and its inner volume can be changed as the ink is drawn out, the open air communication port may be omitted. By installing the flexible sheet bag in a non-deformable case, the sheet bag can be mounted with ease and protected against being damaged by external forces.

Next, the construction and operation of the second ink tank will be explained. In the following the spring in the second ink tank 125 is assumed to be a coil spring for ease of explanation.

The ink introducing tube 12 and the gas discharge tube 13 are inserted through an upper part of the rectangular frame 115 of the second ink tank 125 and securely bonded to the rectangular frame 115 where they contact it. The ink introducing tube 12 is formed with an ink introducing port 12*a* at the lower end thereof and the gas discharge tube 13 is formed with a gas discharge port 13*a* at the lower end thereof, both ports being situated in the second ink tank 125. In the second ink tank 125, the ink introducing port 12*a* is situated lower than the gas discharge port 13*a*. The gas discharge port 13*a* is positioned a short distance from the rectangular frame 115 toward the interior of the second ink tank 125.

Referring to FIGS. 3A, 2B, 3C and 3D, the process of refilling ink into the second ink tank 125 and discharging air from it will be described in detail.

Figure 3A:
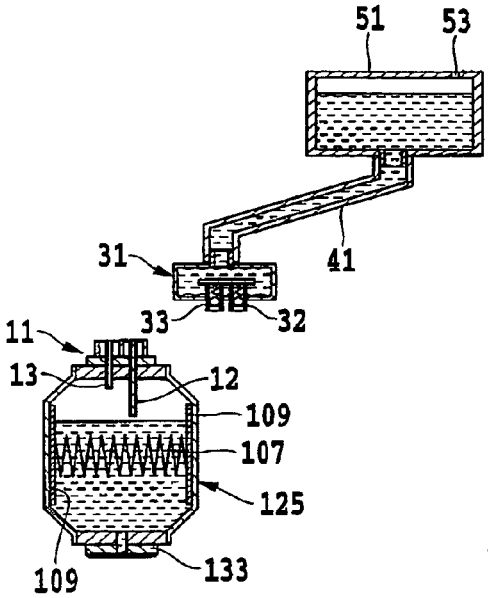
FIGS. 3A, 3B, 3C and 3D are cross-sectional views showing how the ink supply system of FIG. 2 operates.

FIG. 3A shows the state of the second ink tank 125 containing a sufficient amount of ink. In this state, the second ink tank 125 is not connected to the first ink tank 51, with the connector 11 separated from the supply unit 31. Further, the hole 12*b* (see FIG. 4A) in the ink introducing tube 12 is closed with the seal rubber 26 and the front end hole of the gas discharge tube 13 is also closed similarly. Thus, the interior of the second ink tank 125 is sealed almost airtight.

Figure 3B:
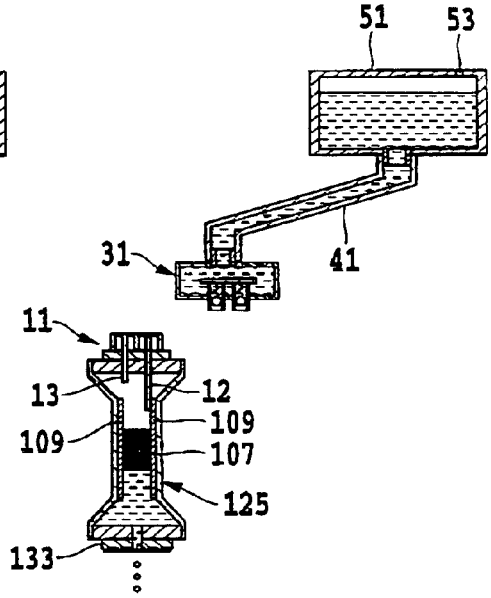

As the printing apparatus starts printing and the ink in the second ink tank 125 begins to be consumed, a pair of two pressure plates 109 move inwardly of the second ink tank 125 from the state of FIG. 3A to reduce the inner volume of the second ink tank 125 (FIG. 3B). Then, as shown in FIG. 3B, a spring 107 installed between the paired pressure plates 109 is compressed and the negative pressure in the second ink tank 125 increases progressively. As the ink volume in the second ink tank 125 further decreases, the paired two pressure plates 109 come closer together and the corresponding negative pressure develops in the second ink tank 125. The negative pressure in the second ink tank 125 is kept within an optimum range of ink supply pressure (negative pressure) for the print head. As the two pressure plates 109 come closer together, the second ink tank shrinks.

Generally, the printing apparatus is often used intermittently. Hence, during the process of consuming the ink in the second ink tank 125, it is very likely that the printing apparatus will be stopped and left idle. While the printing apparatus is left unused, a gas dissolved in the ink may get vaporized or external air may enter into the second ink tank 125 through various parts of the tank 125 to increase the gas volume in the tank 125. The gases that may get into the second ink tank 125 include those entering from the nozzles of the print head and those produced in the tank during the ejection operation of the print head. This gives rise to a possibility that when the second ink tank 125, after ink consumption, is to be refilled with ink from the first ink tank 51, the same amount of ink as was supplied in the previous filling operation may not be able to be supplied into the second ink tank 125 because of an effect of an increased gas volume in the second ink tank 125. To eliminate this problem, when refilling the second ink tank 125, the gas in the second ink tank 125 needs to be discharged at the same time.

Figure 3C:
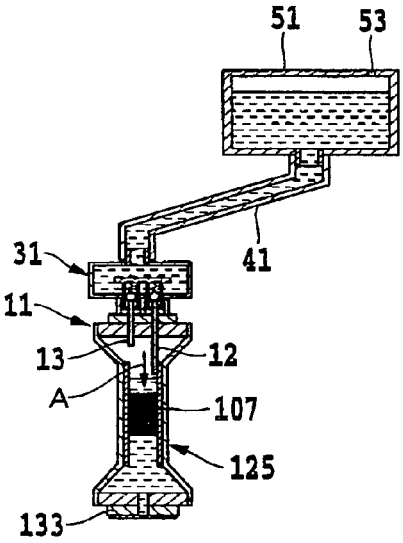

Thus, when more than a predetermined amount of ink is consumed from the second ink tank 125, the gas accumulated in the second ink tank 125 is discharged at the same time that the ink is refilled into the second ink tank 125, as shown in FIG. 3C.

Figure 3D:
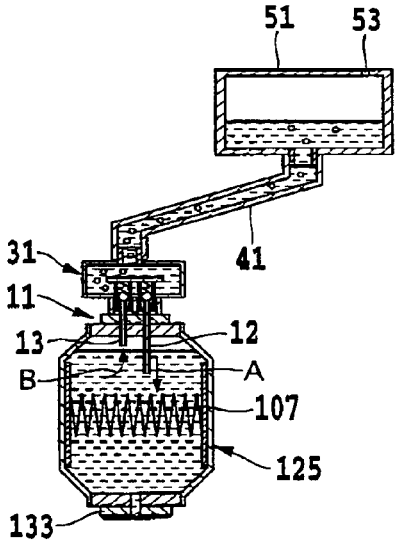

First, the head unit 1 along with the carriage 202 is moved to the home position to set the connector 11 opposite the supply unit 31 for connection. With the connector 11 and the supply unit 31 connected, the interior of the second ink tank 125 communicates with the interior of the first ink tank 51 through the ink introducing tube 12 and gas discharge tube 13. The negative pressure in the second ink tank 125 causes the ink to flow from the first ink tank 51 to the second ink tank 125 in the direction of arrow A in FIG. 3C through the ink introducing tube 12 and gas discharge tube 13. As the ink flows into the second ink tank 125, the inner volume of the second ink tank 125 progressively increases, facilitated by the recovery force of the spring 107 compressed between the pressure plates 109, until the second ink tank 125 reaches a final state as shown in FIG. 3D in which the tank sheets 106 are tensed to the maximum and the inner volume of the second ink tank 125 is at its maximum capacity.

The first ink tank 51 has an open air communication port 53 formed in its upper part to communicate its interior with an open atmosphere and keep the interior at an atmospheric pressure. So, the ink in the first ink tank 51 is supplied to the second ink tank 125 through the ink introducing tube 12 and the gas discharge tube 13. As the second ink tank 125 is progressively filled with ink and the ink level in the second ink tank 125 rises, a gas in a space above the ink level is compressed and its pressure increases. The pressurized gas now tends to escape from the second ink tank 125 to the first ink tank 51 through the ink introducing tube 12 and gas discharge tube 13. In this example, since the gas discharge tube 13 is shorter than the ink introducing tube 12, the pressure or water head at the lower end of the gas discharge tube 13 is smaller than that of the lower end of the ink introducing tube 12. As a result, the gas in the second ink tank 125 more easily escapes through the gas discharge tube 13 than through the ink introducing tube 12. Thus, when the interior of the second ink tank 125 reaches a predetermined pressure, the gas in the second ink tank 125 is discharged through the gas discharge tube 13 out into the first ink tank 51 as indicated by an arrow B of FIG. 3D. Simultaneously with the gas discharge from the second ink tank 125, the ink in the first ink tank 51 is introduced into the second ink tank 125 through the ink introducing tube 12 as indicated by an arrow A of FIG. 3D. When the ink introducing tube 12 is submerged below the ink level as shown in FIG. 3D, the functions of the ink introducing tube 12 and the gas discharge tube 13 are more clearly differentiated, with the ink introducing tube 12 assigned for introducing the ink and the gas discharge tube 13 assigned for discharging the gas.

The gas in the second ink tank 125 is discharged out into the first ink tank 51 as bubbles. That is, the bubbles enter the gas discharge port 13*a* at the lower end of the gas discharge tube 13 and travel through the supply unit 31 and the ink path 41 toward the first ink tank 51 located at a higher position in a gravity direction. The first ink tank 51 is constructed simply as a container to accommodate a liquid ink, so the gas discharged into the interior of the first ink tank 51 moves up to an upper space in the tank 51 and escapes through the open air communication port 53 into the open air.

The ink refilling accompanied by the gas discharge is performed until the ink level in the second ink tank 125 reaches the gas discharge port 13*a* of the gas discharge tube 13. That is, when the ink level in the second ink tank 125 reaches the gas discharge port 13*a* of the gas discharge tube 13, the ink refilling operation is automatically stopped. Thus, the ink refilling of the second ink tank 125 does not require any special pump, is smoothly carried out while at the same time discharging the gas, and is automatically stopped when the second ink tank 125 is full.

After a predetermined volume of ink is supplied into the second ink tank 125 in a manner described above, the head unit 1 together with the carriage 202 is moved away from the home position to separate the connector 11 from the supply unit 31 and is ready for printing. Separation between the connector 11 and the supply unit 31 causes the hole 12*b* at the front end of the ink introducing tube 12 (see FIG. 4A) to be closed by the seal rubber 26 and the hole at the front end of the gas discharge tube 13 also to be closed similarly, sealing the interior of the second ink tank 125 almost hermetically.

(Second Embodiment)

Figure 5:
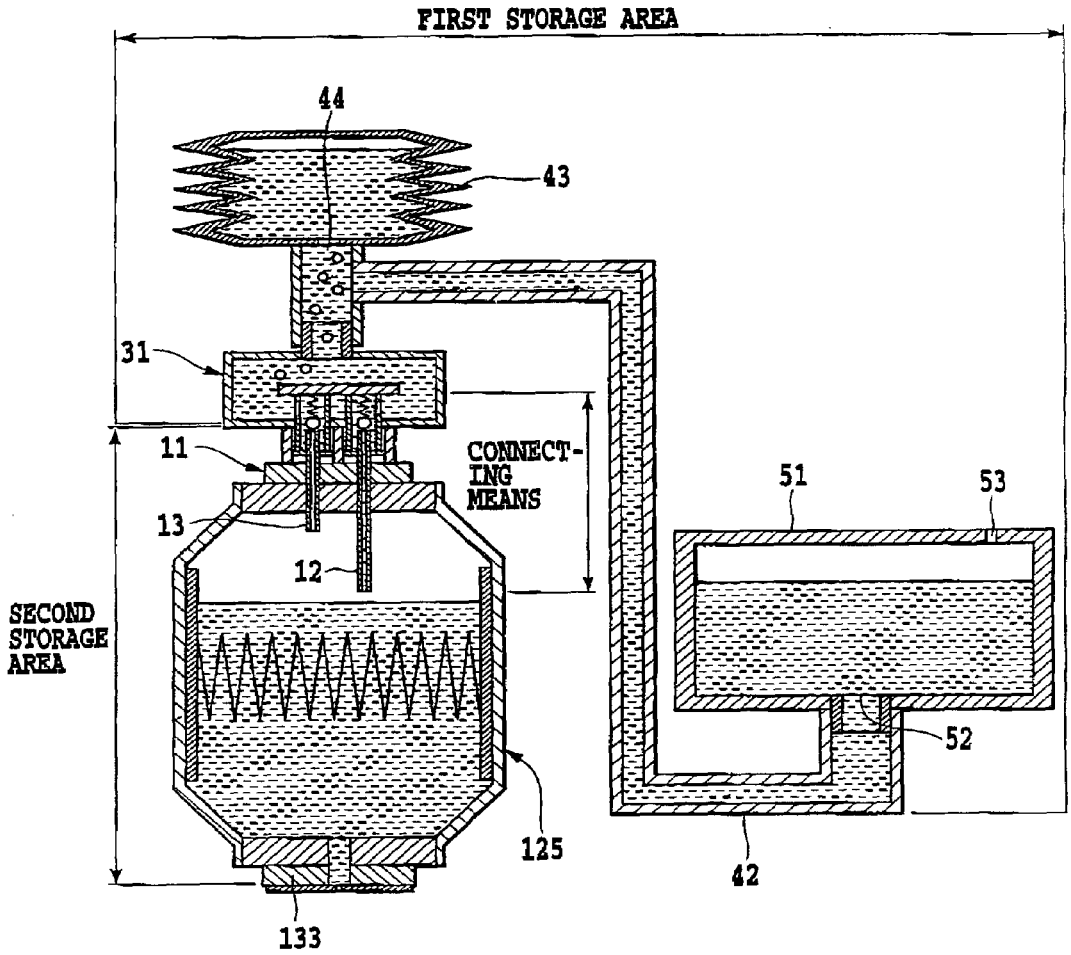
FIG. 5 is a cross-sectional view showing an outline construction of an ink supply system in a second embodiment of the present invention.

FIG. 5 illustrates a second embodiment of the present invention. This embodiment represents a case where the first ink tank 51 is not necessarily installed at a position higher than that of the second ink tank 125. In this example too, as shown in FIG. 5, an area from the first ink tank 51 to the ink path 42 to the supply unit 31 may be defined as a first ink storage area, an area from the ink introducing tube 12 and gas discharge tube 13 to the head chip 133 as a second ink storage area, and an area from the ink supply tube 32 and gas extraction tube 33 to the ink introducing tube 12 and gas discharge tube 13 as a connecting means.

As shown in FIG. 5, even when the first ink tank 51 is not installed at a position higher than the second ink tank 125, a connection between the connector 11 and the supply unit 31, both constituting a connection unit, causes the ink to be supplied from the first ink tank 51 to the second ink tank 125 as in the first embodiment described above. However, the gas discharged from the second ink tank 125 does not move to the first ink tank 51 which is situated lower than the second ink tank 125. Hence, a gas accommodating chamber 43 is provided in the ink path 42 to temporarily accommodate the gas discharged from the second ink tank 125. The gas accommodating chamber 43 is shaped like a bag and made of a material such as nylon which is flexible but not elastic. The gas accommodating chamber 43 has a hole to which an opening 44 in the ink path 42 is connected.

In this construction a process of filling ink and discharging gas will be explained by referring to FIGS. 6A, 6B, 6C and 6D and FIGS. 7A and 7B.

Figure 6A:
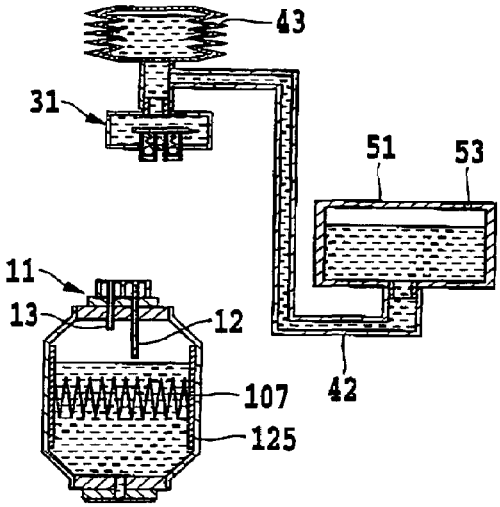
FIGS. 6A, 6B, 6C and 6D are cross-sectional views showing how the ink supply system of FIG. 5 operates.

First, when a sufficient amount of ink is present in the second ink tank 125, the connector 11 is separated from the supply unit 31, as shown in FIG. 6A. At this time, since no gas is discharged into the gas accommodating chamber 43, the gas accommodating chamber 43 is almost filled with ink.

Figure 6B:
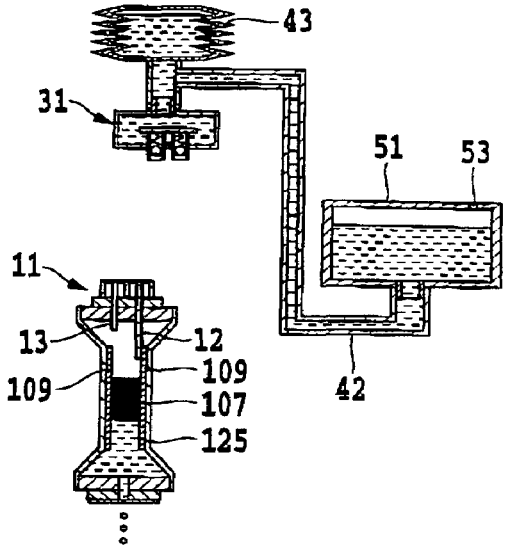

FIG. 6B shows the second ink tank 125 in a deformed state as a result of consumption of the ink contained in it. As the pressure plates 109 come closer together, the spring 107 is compressed but the interior of the second ink tank 125 is still kept in an optimum range of negative pressure to supply ink to the print head.

Figure 6C:
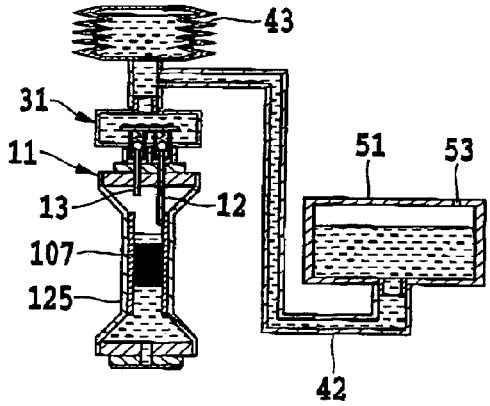

When the ink is supplied into the second ink tank 125, the connector 11 and the supply unit 31 are connected, as shown in FIG. 6C. With the connector 11 and the supply unit 31 connected, the negative pressure in the second ink tank 125 draws the ink from the first ink tank 51 into the second ink tank 125, as in the previous embodiment.

Figure 6D:
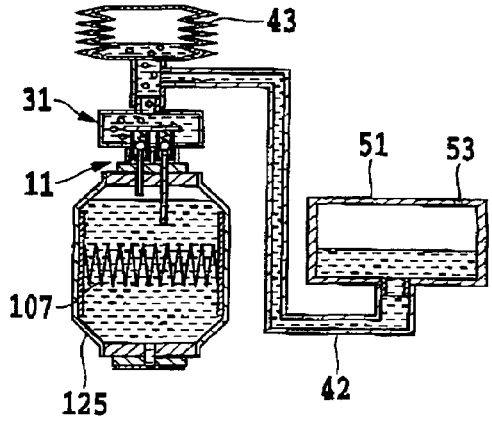

As the ink flows as described above, the second ink tank 125 inflates, assisted by the recovery force of the spring 107, as shown in FIG. 6D and the ink level in the second ink tank 125 progressively rises. At the same time the gas present in the second ink tank 125 enters into the gas accommodating chamber 43 through the gas discharge tube 13. As the gas discharged from the second ink tank 125 enters into the gas accommodating chamber 43, the ratio of the gas occupying the gas accommodating chamber 43 gradually increases and the ink in the gas accommodating chamber 43 which is decreasing in volume flows into the second ink tank 125.

Figure 7A:
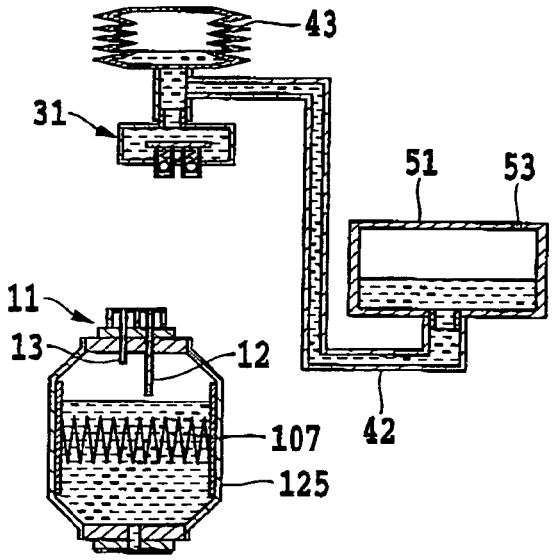
FIGS. 7A and 7B are cross sectional views showing how the ink supply system of FIG. 5 operates.

After a series of ink filling and gas discharging operations is finished, the connector 11 is disconnected from the supply unit 31 as shown in FIG. 7A. In this disconnected state, the supply unit 31 is hermetically closed, so that the gas discharged into the gas accommodating chamber 43 remains there.

Figure 7B:
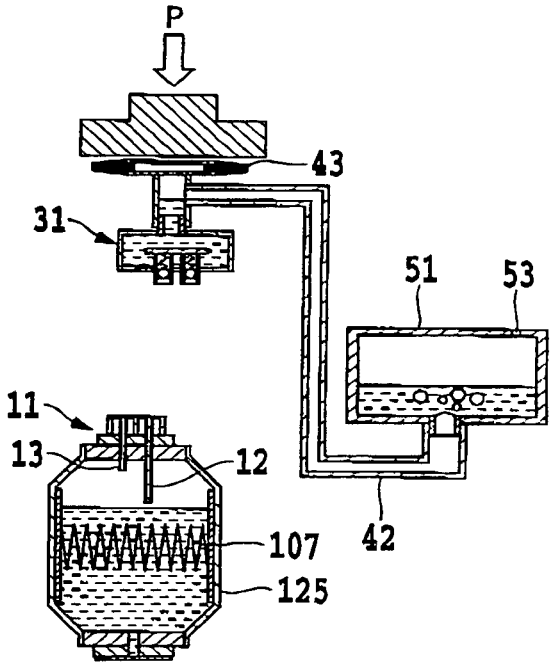

Next, as shown in FIG. 7B, when an external force P is applied to the gas accommodating chamber 43, the baglike gas accommodating chamber 43 collapses causing the gas therein to flow through the ink path 42 into the first ink tank 51. A press means to press the gas accommodating chamber 43 may be installed in the printing apparatus as required.

In this construction, the inner volume of the gas accommodating chamber 43 needs to be set larger than the inner volume of the ink path 42. If the inner volume of the gas accommodating chamber 43 is smaller than that of the ink path 42, there is a possibility that when the gas accommodating chamber 43 recovers its original shape after the gas in the chamber has been delivered to the first ink tank 51, the gas may remain in the ink path 42. That is, when the gas accommodating chamber 43 is collapsed by the external force to send the gas from the gas accommodating chamber 43 to the first ink tank 51 and then relieved of the external force to return to its original state, causing the ink in the first ink tank 51 to flow into the gas accommodating chamber 43, the gas in the ink path 42 cannot be sufficiently replaced with the ink, leaving the gas to remain near the connecting portion between the ink path 42 and the gas accommodating chamber 43. The residual gas may get delivered into the second ink tank 125. Therefore, the inner volume of the gas accommodating chamber 43 is set larger than that of the ink path 42.

(Third Embodiment)

Figure 16:
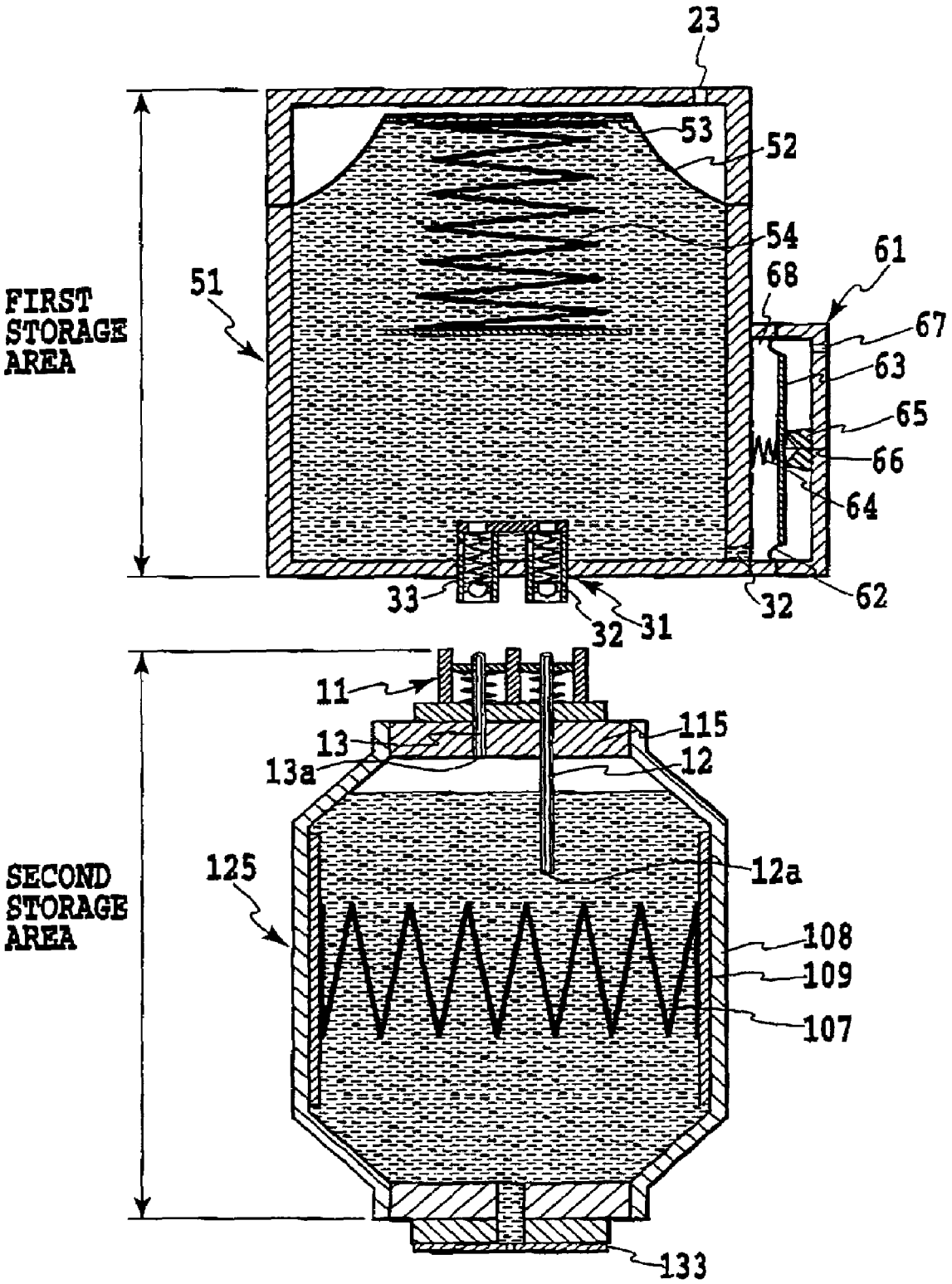
FIG. 16 is a cross-sectional view showing an outline construction of an ink supply system in a third embodiment of the present invention when two components of the ink supply system are disconnected.
Figure 17:
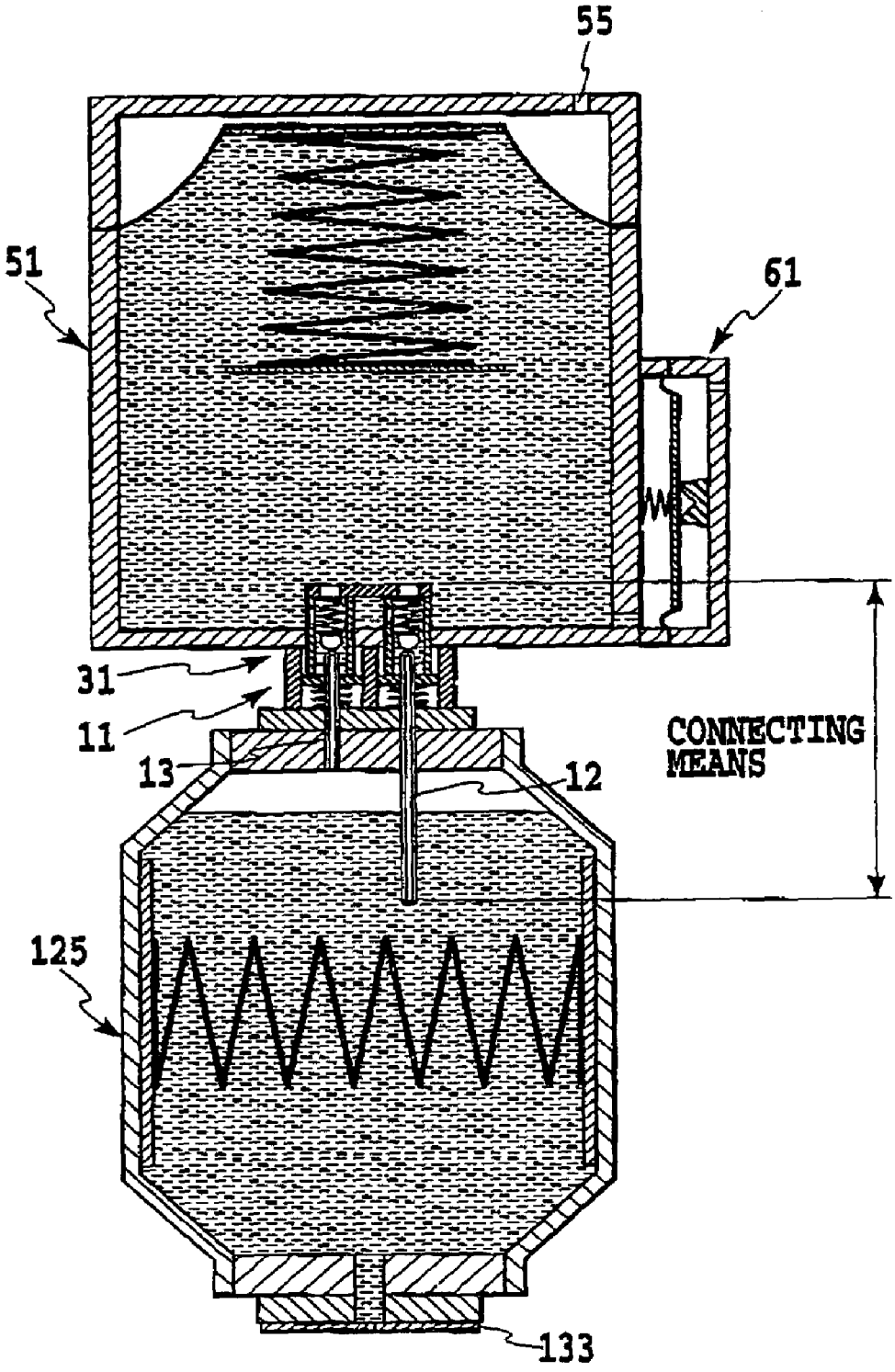
FIG. 17 is a cross-sectional view showing an outline construction of the ink supply system in the third embodiment of the present invention when two components of the ink supply system are connected.

FIGS. 16 and 17 illustrate a third embodiment of this invention. The first ink container (first ink tank) 51 in this example is partitioned into two chambers, an ink chamber and a valve chamber 68, which are communicated with each other through a communication port 56.

A deformable, flexible film (sheet member) 52 is provided in one part of the first ink container 51. Between the sheet member 52 and an inner surface of the first ink container 51 is formed a space (ink chamber) to accommodate ink. A space in the first ink container 51 on the outside of the sheet member 52, i.e., a space above the sheet member 52 in FIG. 16, is open to an atmosphere through an open air communication port 55 and set equal to an atmospheric pressure. The first ink container 51, excluding a connect portion for the supply unit 31 provided below and a communication path to the valve chamber 68, essentially forms a hermetically closed space.

A central portion of the sheet member 52 is restricted in deformation by a pressure plate 53, a flat support member, with a peripheral portion of the sheet member 52 made deformable. The sheet member 52 is formed convex at its central portion, with its side surfaces sloping down. As described later, the sheet member 52 is deformed according to ink volume changes and pressure variations in the first ink container 51. The peripheral portion of the sheet member 52 shrinks and deforms with a good overall balance and the central portion of the sheet member 52 moves vertically in the figure while keeping its horizontal attitude. Since the sheet member 52 deforms (or moves) smoothly, no impacts are produced by the deformation and thus no abnormal pressure variations due to impacts are produced in the first ink container 51.

Further, in the first ink container 51 there is provided a spring member 54 of a compression type that urges the sheet member 52 upward in the figure through the pressure plate 53. The action of the pressing force of the spring member 54 generates a negative pressure in a range of magnitude that enables ink ejection from the print head, the negative pressure being balanced with a holding force of a meniscus formed in each ink ejection opening in the print head. FIG. 16 and FIG. 17 show a state in which the first ink container 51 is almost filled with ink and in which the spring member 54 is still compressed, producing an appropriate negative pressure in the first ink container 51.

A one-way valve 61 is provided to introduce air from outside when the negative pressure in the first ink container 51 exceeds a predetermined value and to prevent an ink leakage from the first ink container 51. The one-way valve 61 has a pressure plate 63 and a seal member 65. The pressure plate 63 acts as a valve closing member having an open air introducing port 66 and the seal member 65 is secured to a case of the valve chamber 68 to oppose and hermetically close the open air introducing port 66. The valve chamber 68, excluding the communication port 56 to the first ink container 51 and an open air introducing port 66, maintains a virtually hermetic, closed space. Inside the case of the valve chamber 68, a space on the right side of a sheet member 62 in the figure is open to atmosphere through the open air communication port 67 and thus set equal to an atmospheric pressure. The sheet member 62 has its central portion joined to the pressure plate 63 with its peripheral portion made deformable. This construction enables a smooth movement of the pressure plate 63 as the valve closing member to the left and right in the figure.

In the valve chamber 68 a spring member 64 is installed as a valve restriction member to restrict a valve opening action. The spring member 64 is kept slightly compressed so that a reactive force of the compressed spring urges the pressure plate 63 toward right in the figure. The expansion and compression of the spring member 64 gives a seal member 65 a valve function to close and open the open air introducing port 66. The seal member 65 also has a function of one-way valve or check valve that permits a gas to be introduced from the open air communication port 67 through the open air introducing port 66 into the valve chamber 68.

The seal member 65 need only be able to reliably close the open air introducing port 66 airtight. That is, the seal member 65 needs to be formed in such a shape as will secure an airtightness and its material is not limited to any particular material. For example, the seal member 65 may be formed such that at least a portion of the seal member 65 closing the open air introducing port 66 can keep a smooth contact with a surface of the pressure plate 63 surrounding the open air introducing port 66. Or, the seal member 65 may have a rib capable of hermetically contacting the surface of the pressure plate 63 around the open air introducing port 66. Preferably, the seal member 65 is formed of an elastic body such as flexible rubber that can easily follow deformations of the sheet member 62 and the pressure plate 63.

In the construction of the first ink container 51, as the ink is consumed from an initial state of the container 51 full of ink, the negative pressure in the ink chamber of the first ink container 51 balances with the force of the valve restriction member (spring member 64) in the valve chamber 68. When from this balanced state the ink continues to be consumed and the negative pressure in the ink chamber of the first ink container 51 further increases, the open air introducing port 66 is opened allowing external air to flow into the ink chamber of the first ink container 51. Since the sheet member 52 and the pressure plate 53 can be displaced upward in the figure, the inflow of air increases the volume of the ink chamber and at the same time reduces the negative pressure in the ink chamber, closing the open air introducing port 66 again.

Further, when the environment surrounding the first ink container 51 changes, such as temperature rise and pressure reduction, the air trapped in the ink chamber is allowed to expand by a volume equivalent to a displacement of the sheet member 52 and pressure plate 53 from their lowermost displacement position to the initial position. In other words, a space equivalent to that volume functions as a buffer space. It is thus possible to alleviate a pressure increase caused by surrounding environmental changes and thereby effectively prevent an ink leakage from the nozzles of the print head.

Further, since no external air is introduced into the ink chamber before the buffer space is secured in the first ink container 51 by the ink being consumed from the initial ink-filled state of the container, even if sharp changes in surrounding environment occur or the container vibrates or falls, no ink leakage will result. Further, since the buffer space is not secured in advance even before the ink begins to be used, the first ink container 51 has a high volume efficiency and is constructed compact.

Although in the above example the spring member 54 in the first ink container 51 and the spring member 64 in the valve chamber 68 are both shown schematically in the form of a coil spring, other forms of spring can also be used. For example, they may be a conical coil spring or a leaf spring. When a leaf spring is used, a pair of leaf spring members, vertically symmetrical to each other and roughly U-shaped in cross section, may be combined so that their open ends of U-shaped structure oppose each other.

The second ink container (second ink tank) 125 in this example is constructed in the same way as described above. In this example, the gas transfer port (gas discharge port) 13*a* of the gas transfer tube (gas discharge tube) 13 is situated on almost the same plane as an upper inner surface of the rectangular frame 115.

Next, referring to FIGS. 18A to 18F, the process of refilling an ink into the second ink container (second ink tank) 125 and releasing a gas from the second ink container (second ink tank) 125 will be described in detail.

Figure 18A:
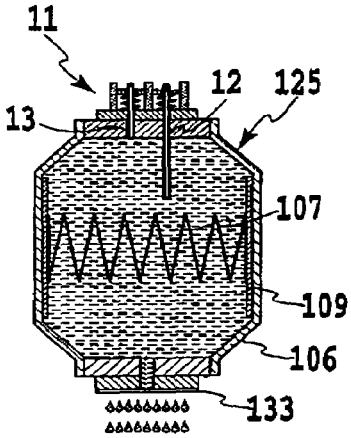
FIGS. 18A, 18B, 18C, 18D, 18E and 18F are cross-sectional views showing how the ink supply system of FIG. 16 operates.
Figure 18B:
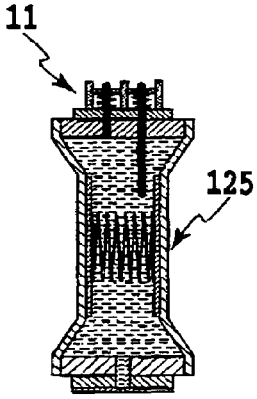
Figure 18C:
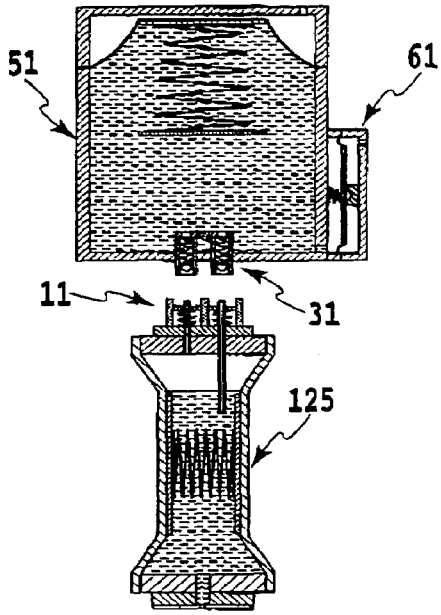

A state in which a sufficient amount of ink is present in the second ink container 125 as shown in FIG. 18A, a state in which most of the ink in the second ink container 125 has been consumed as shown in FIG. 18B, and a state in which an external gas has entered into the second ink container 125 and remains in an upper part of the container as shown in FIG. 18C are similar to those in FIG. 3A and FIG. 3B. As described above, the gas that stays in the second ink container 125 either enters from the nozzles of the print head or is generated during the ink ejection operation of the print head.

As in the preceding embodiments, when more than a predetermined volume of ink in the second ink container 125 has been consumed, this embodiment also supplies ink into the second ink container 125 and at the same time transfers the gas from the second ink container 125.

Figure 18D:
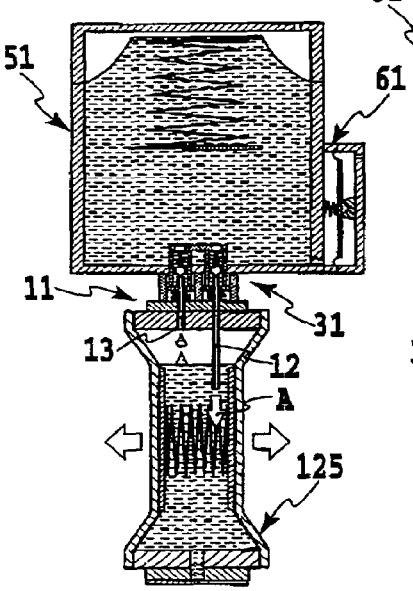

First, the head unit 1 together with the carriage 202 moves to the home position to oppose the connector 11 to the supply unit 31 for connection (see FIGS. 18C and 18D). With this connection established, the second ink container 125 communicates with the first ink container 51 through the ink introducing tube 12 and the gas transfer tube 13. As a result, a negative pressure in the second ink container 125 causes the ink to flow in the direction of arrow A of FIG. 18D from the first ink container 51 into the second ink container 125 through the ink introducing tube 12 and the gas transfer tube 13. In this way the ink is supplied into the second ink container 125 through both of the ink introducing tube 12 and the gas transfer tube 13, which serve as multiple communication paths connected with the first ink container 51. The inflow of ink allows the inner volume of the second ink container 125 to progressively increase, facilitated by the recovery force of the spring 107 compressed by the pressure plates 109.

Figure 18E:
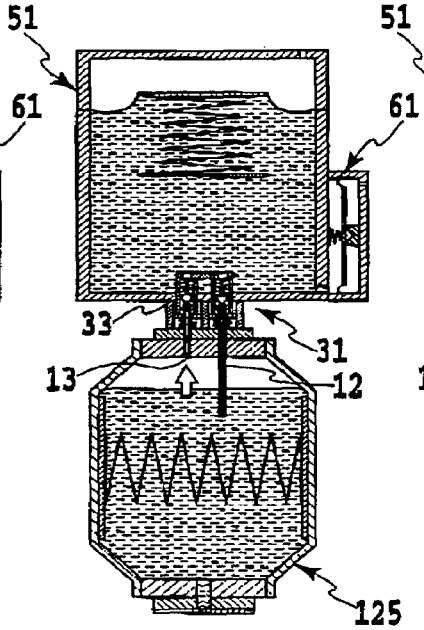

Then, when the inner volume of the second ink container 125 becomes almost maximum, as shown in FIG. 18E, the gas in the second ink container 125 is transferred through the gas transfer tube 13 and the gas extraction tube 33 into the first ink container 51 and at the same time ink is supplied into the second ink container 125. That is, the ink supplied into the second ink container 125 compresses the gas in the second ink container 125 and a resulting pressure increase breaks ink meniscus formed in the gas transfer tube 13, allowing the gas in the second ink container 125 to be transferred into the first ink container 51. At the same time, the ink in the first ink container 51 is introduced into the second ink container 125 through the ink introducing tube 12. When the ink introducing port 12*a* of the ink introducing tube 12 submerges in the ink, the functions of the ink introducing tube 12 and the gas transfer tube 13 are more clearly differentiated, with the tube 12 dedicated to introducing the ink and the tube 13 dedicated to transferring the gas.

Figure 18F:
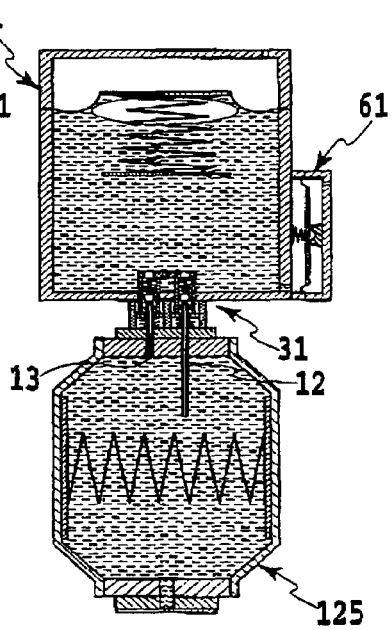

This ink filling process accompanied by the gas transfer continues until the ink level in the second ink container 125 reaches the gas transfer port 13*a* of the gas transfer tube 13, as shown in FIG. 18F. That is, when the ink level in the second ink container 125 reaches the gas transfer port 13*a* of the gas transfer tube 13, the ink filling operation automatically stops.

Next, referring to FIG. 19A and FIG. 19B, a pressure balance that is established as the gas is transferred from the second ink container 125 will be explained in detail. Our explanation focuses on an assumed stationary state in which the state of FIG. 18D, the ink supply and the gas transfer are executed, come to rest.

First, a gas pressure in the second ink container 125 is considered. Let a gas pressure in the first ink container 51 be P and a pressure produced by a water head difference between the ink level in the second ink container 125 and the ink level in the first ink container 51 be Hs. Then, the pressure acting on the meniscus of ink formed in the gas transfer tube 13 on the side of the second ink container 125 is Hs larger than the gas pressure P in the first ink container 51, or P+Hs. The pressure increase resulting from the water head is produced because the gas in the second ink container 125 is hermetically sealed, and is not produced in a construction in which the second ink container 125 is open to atmosphere through an atmosphere communication port in the connector 11.

Next, a pressure balance at a meniscus formed in the opening of the gas transfer tube 13 on the side of the second ink container 125 is considered. The meniscus at this position is acted upon by a downward pressure of P+Ha and an upward pressure of P+Hs. Since it is assumed that the upward and downward pressures balance each other, it is understood that a vertical pressure difference is balanced with a pressure Ma produced by the meniscus given below.

$$Ma=2\gamma\cdot\cos\theta a/Ra \quad (1)$$

where $\gamma$ is a surface tension of ink, $\theta a$ is a contact angle at which the ink contacts the gas transfer tube 13, and Ra is a diameter (inner diameter) of the gas transfer tube 13.

Thus, the pressure balance at the opening of the gas transfer tube 13 on the print head side is expressed as follows.

$$(P+Hs)-(P+Ha)=Ma \quad (2)$$

$$Hs-Ha=Ma \quad (3)$$

That is, the pressure produced by a water head difference between the meniscus position in the gas transfer tube 13 is balanced with the pressure (Ma) produced by the meniscus in the gas transfer tube 13.

Therefore, when the volume of gas in the second ink container 125 increases and the following relation holds $$Hs-Ha>Ma \quad (4)$$

then the increased gas pressure in the second ink container 125 breaks the meniscus in the gas transfer tube 13, allowing the gas in the second ink container 125 to move into the first ink container 51. As a result, the ink in the first ink container 51 moves through the ink supply tube 32 and the ink introducing tube 12 into the second ink container 125, raising the ink level in the second ink container 125.

Since the inner volume of the gas transfer tube 13 is very small compared with that of the supply unit 31, at an initial stage at which the gas begins to move, the ink level in the second ink container 125, whose inner volume is relatively large, does not rise significantly and the meniscus position in the gas transfer tube 13 quickly moves toward the upper opening of the tube on the first ink container 51 side. Hence, the pressure produced by a water head difference between the upper opening position of the gas transfer tube 13 on the first ink container 51 side and the ink level in the first ink container 51 becomes small. The pressure inside the second ink container 125 is now significantly larger than a pressure Ma' of the meniscus formed in the gas transfer tube 13. The reduced downward pressure acting on the meniscus and the increased pressure in the second ink container combine to ensure a smooth transfer of the gas. Ma' is a pressure produced by the meniscus formed in the gas transfer tube 13 on the first ink container 51 side.

Then, if a pressure La produced by a water head equivalent to the length of the gas release tube 13 is as follows, the gas is transferred as shown in FIG. 18E.

$$La<Ma+Ma' \quad (5)$$

In the above, we have discussed a case in which the lower end opening of the ink introducing tube 12 on the second ink container 125 side is in contact with the ink. If the apparatus is left unused for a long period of time, a large amount of gas may enter into the second ink container 125 and the lower end opening of the ink introducing tube 12 may get out of contact with the ink in the second ink container 125, as shown in FIG. 19B. Let us now discuss this situation.

In the foregoing explanation, since the lower end opening of the ink introducing tube 12 on the second ink container 125 side is in contact with the ink, we need only consider the pressure balance at the meniscus position in the gas transfer tube 13. In the state of FIG. 19B, however, the ink meniscus formed in the ink introducing tube 12 must also be considered.

Figure 19B:
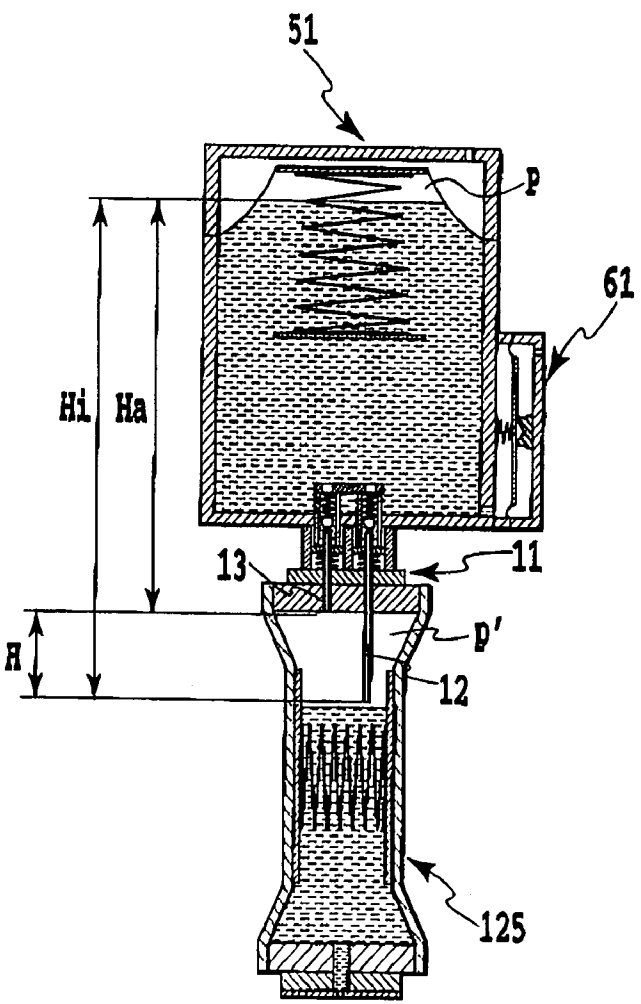
FIGS. 19A and 19B are cross-sectional views showing a pressure balance in the ink supply system of FIG. 16.
Figure 19A:
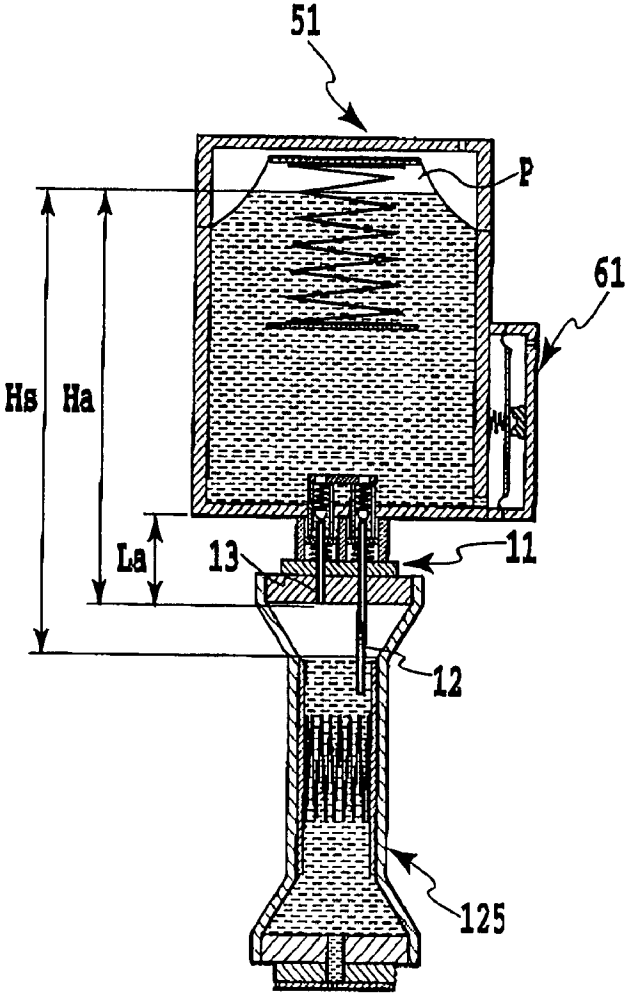

Let us consider an instantaneous state of FIG. 19B in equilibrium. If we let a gas pressure in the second ink container 125 be P' and a pressure produced by the meniscus formed in the ink introducing tube 12 be Mi, then the pressure balance at the positions of the meniscuses in the ink introducing tube 12 and the gas transfer tube 13 in the state of FIG. 19B is expressed as follows.

$$P'-(P+Ha)=Ma,\ P'-(P+Hi)=Mi \tag{6}$$

Here, for the ink supply and the gas transfer to be performed, the following conditions must be established:

$$P'-(P+Ha)>Ma,\ P'-(P+Hi)<Mi$$

From this, we get $$P'-P>Ha+Ma,\ P'-P<Hi+Mi$$

That is, $$Hi+Mi>Ha+Ma$$

$$Hi-Ha=H>Ma-Mi \tag{7}$$

Therefore, whether the ink supply and the gas transfer are performed or not is determined by a pressure difference H equivalent to a water head difference in the vertical direction between the lower end openings, on the second ink container 125 side, of the ink introducing tube 12 and the gas transfer tube 13 and by a pressure difference (Ma−Mi) produced by meniscuses in the ink introducing tube 12 and the gas transfer tube 13.

As described above, in this embodiment, a connection means having a plurality of passages is provided between the first and second ink containers 51, 125 and the heights of the lower end openings of these paths on the second ink container 125 side are differentiated. This construction enables the gas in the second ink container 125 to be swiftly transferred to the first ink container 51, without complicating the construction. By using this connection means with multiple passages, the ink is supplied from the first ink container 51 to the second ink container 125. Further, since, after the gas in the second ink container 125 has been transferred to the first ink container 51, the first ink container 51 has a predetermined level of negative pressure, the second ink container 125 at the end of the ink refilling will have the same negative pressure as that of the first ink container 51. Thus, after the ink has been supplied into the second ink container 125, there is no need to perform an initial negative pressure generation processing to produce a negative pressure in the second ink container 125 as by performing a suction-based ink discharge and a preliminary ejection. The suction-based ink discharge is an operation to suck out ink from the nozzles of the print head which does not contribute to printing, and the preliminary ejection is an operation to eject ink from the nozzles of the print head which does not contribute to printing.

The negative pressure generation means to produce a negative pressure in the first ink container 51 may be a negative pressure adjust mechanism, such as shown in FIG. 16, which incorporates a one-way valve 61 that introduces a gas from outside when the negative pressure in the first ink container 51 exceeds a predetermined value. The negative pressure generation means may also be a negative pressure generation mechanism described below.

Figure 20A:
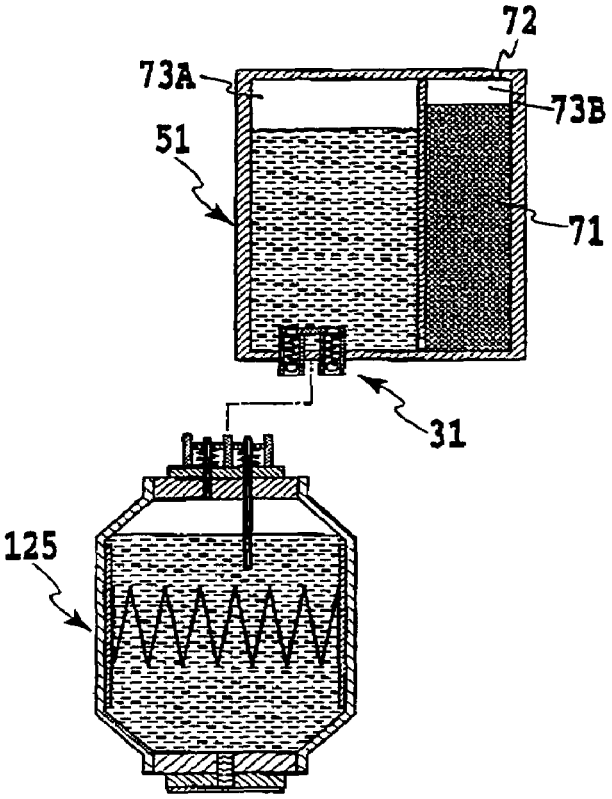
FIGS. 20A, 20B and 20C are cross-sectional views showing other example constructions of the first ink container of the third embodiment of the present invention.

FIG. 20A illustrates the first ink container 51 equipped with a negative pressure generation means using a capillary tube member (negative pressure generation member) 71. The capillary tube member 71 is made of a polymer foam such as polyurethane and melamine and of a material having an ink resistance such as polyolefin and polyester, and designed to produce an appropriate magnitude of capillary attraction force between it and the ink. The capillary tube member 71 as a negative pressure generation member also has an effect of alleviating pressure variations due to temperature changes in the first ink container 51. For example, when ambient pressure falls or temperature rises, air in an ink chamber 73A on the left side in FIG. 20A expands. The expanded volume of air is absorbed by a capillary tube member 71 in an ink chamber 74B on the right side in the FIG. 20A to stabilize the negative pressure in the ink chamber 73A and also to prevent an ink leakage. Denoted 72 is an atmosphere communication port to communicate the interior of the ink chamber 73B to the atmosphere.

Figure 20B:
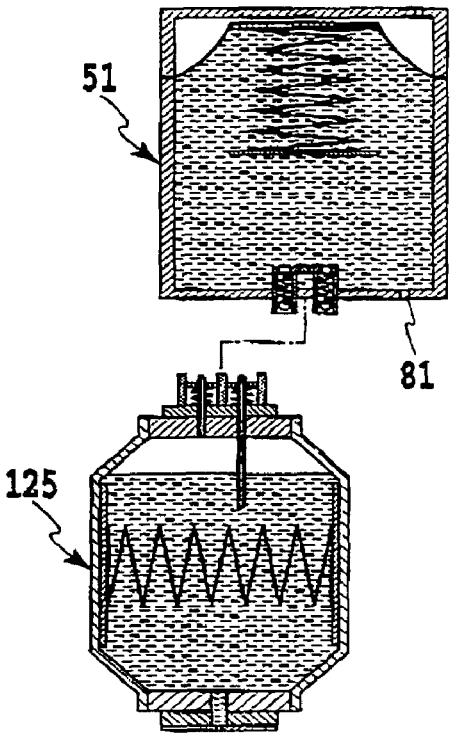

FIG. 20B illustrates an example construction using other than the negative pressure adjust means for the first ink container 51 of FIG. 16. The negative pressure adjust means shown here is a negative pressure adjust mechanism that has a small air hole (atmosphere communication port) 81 formed in a bottom of the first ink container 51 and uses an ink meniscus formed in the air hole 81. This mechanism breaks the meniscus in the air hole 81 when the negative pressure in the first ink container 51 becomes excessive, thus introducing air from outside to keep the pressure in the first ink container 51 constant.

Figure 20C:
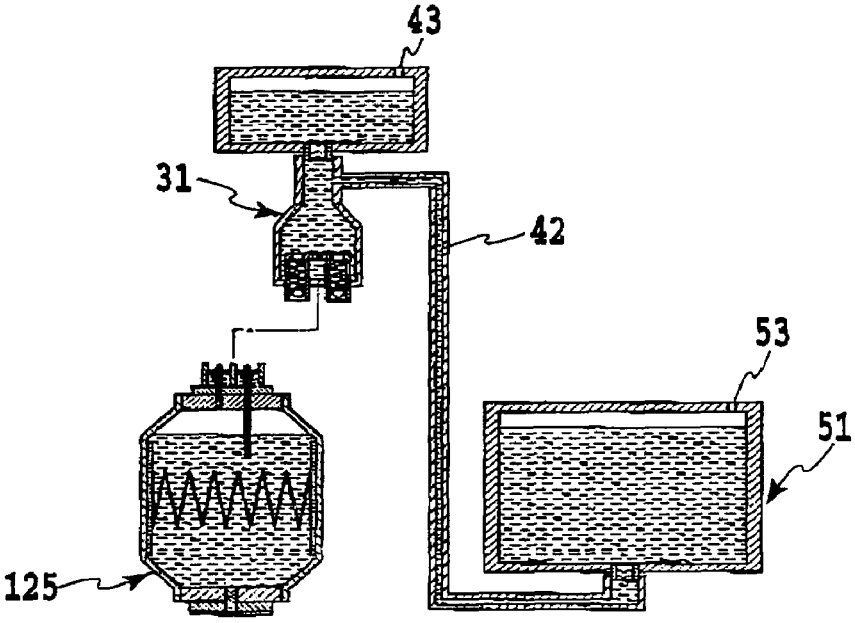

FIG. 20C shows an example construction of a negative pressure generation mechanism that generates a negative pressure based on a water head difference.

The ink level in the first ink container 51 is positioned lower in a gravity direction than the nozzles of the print head to generate a negative pressure by a water head of the ink. As the ink is introduced from the first ink container 51 through an ink path 42 into the second ink container 125 and an ink volume in the first ink container 51 decreases, air is introduced through an atmosphere communication port 53. This keeps the pressure inside the first ink container 51 at an atmospheric pressure at all times, ensuring a smooth delivery of the ink. Therefore, the atmosphere communication port 53 need only be open after at least the ink begins to be consumed, i.e., after the first ink container 51 is mounted on the printing apparatus. In other words, the atmosphere communication port 53 may be closed, for instance, with a seal member until the first ink container 51 is mounted on the printing apparatus Further, the fact that the atmosphere communication port 53 is closed until the first ink container 51 is mounted is effective in preventing leakage and evaporation from the first ink container 51 of the ink filled in the container 51 before its use. Further, the opening of the atmosphere communication port 53 during the use of the first ink container 51 can be accomplished by a user peeling off a seal that closes the atmosphere communication port 53 or puncturing the seal with a needle immediately before mounting the first ink container 51 on the printing apparatus.

While in the example of FIG. 20C, the first ink container 51 has been described to be a molded container, it may be formed of a bag-shaped, flexible sheet. In that case, the sheet deforms as the ink is extracted and its inner volume can be changed according to the ink volume accommodated therein, so that the atmosphere communication port 53 may be omitted. The flexible sheet bag may be accommodated in a non-deformable case to ensure an ease of mounting and protect the sheet against damage. To hold a gas transferred from the second ink container 125, a gas accommodating chamber 43 is provided above the supply unit 31. The gas accommodating chamber 43 can accommodate the gas transferred from the second ink container 125 and thereby complete the ink supply operation while maintaining the negative pressure in the second ink container 125 by the negative pressure in the first ink container 51.

In addition to the constructions shown in FIG. 20A, FIG. 20B and FIG. 20C, the negative pressure generation mechanism may have also a variety of constructions as long as they can maintain an appropriate level of negative pressure.

Since the filling of ink into the second ink container 125 requires no special pump, the printing apparatus can be prevented from increasing in size and complexity. Further, since a plurality of communication paths (in the embodiments described above, two paths) are provided between the first and second ink containers 51, 125, it is possible to transfer the gas from the second ink container 125 into the first ink container 51 during each ink refilling operation to assure a stable volume of ink in the second ink container 125. Further, by taking advantage of the negative pressure in the first ink container 51, the second ink container 125 can be provided with an initial negative pressure to automatically stop the ink refilling operation.

After a predetermined volume of ink has been refilled into the second ink container 125 in this way, the head unit 1 is moved together with the carriage 202 away from the home position to separate the connector 11 from the supply unit 31. The head unit 1 is now ready for printing. When the connector 11 is disconnected from the supply unit 31, the hole 12*b* at the front end of the ink introducing tube 12 (see FIG. 4B) is closed with the seal rubber 26 and the hole at the front end of the gas transfer tube 13 is also closed similarly, sealing the interior of the second ink container 125 almost hermetically again.

(Fourth Embodiment)

FIGS. 21A to 21D and FIGS. 22A and 22B illustrate a fourth embodiment of the invention.

This example represents a construction which moves a gas from the second ink container 125 into the first ink container 51 without placing the first ink container 51 at a position higher than the second ink container 125. In this example, too, as shown in the figure, a region ranging from the first ink container 51 to the ink path 42 to the supply unit 31 may be defined as a first ink storage area, a region ranging from the ink introducing tube 12 and gas transfer tube 13 to the head chip 133 as a second ink storage area, and a region ranging from the ink supply tube 32 and gas extraction tube 33 to the ink introducing tube 12 and gas transfer tube 13 as a connecting means.

Figure 21A:
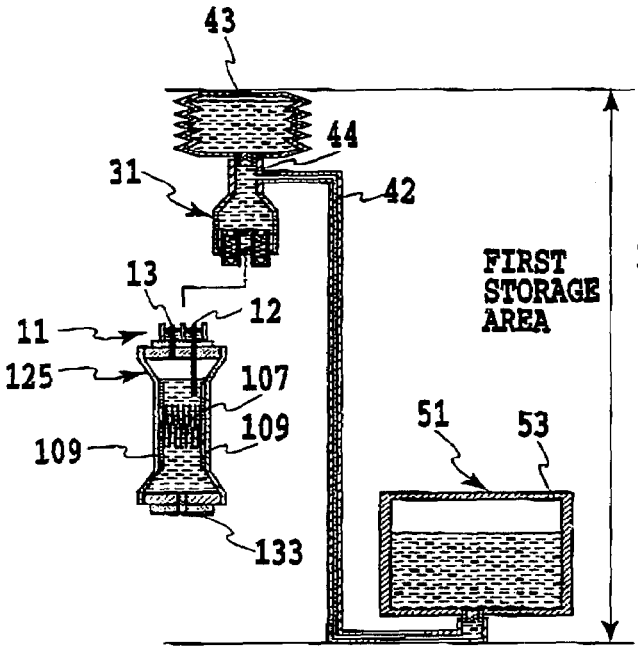
FIGS. 21A, 21B, 21C and 21D are cross-sectional views showing how an ink supply system in a fourth embodiment of the invention operates.

As shown in FIG. 21A, even when the first ink tank 51 is not installed at a position higher than the second ink tank 125, a connection between the connector 11 and the supply unit 31, both constituting a connection unit, causes the ink to be supplied from the first ink tank 51 to the second ink tank 125 as in the third embodiment described above. However, the gas discharged from the second ink tank 125 does not move to the first ink tank 51 which is situated lower than the second ink tank 125. Hence, a gas accommodating chamber 43 is provided in the ink path 42 to temporarily accommodate the gas discharged from the second ink tank 125. The gas accommodating chamber 43 is shaped like a bag and made of a material such as nylon which is flexible but not elastic. The gas accommodating chamber 43 has a hole to which an opening 44 at one end of the ink path 42 is connected.

The process of filling ink and transferring gas in this example of construction will be explained by referring to FIGS. 21A to 21D and FIGS. 22A and 22B.

FIG. 21A shows a state in which the second ink container 125 is deformed after the ink in the container has been consumed As the pressure plates 109 come closer together, the spring 107 is compressed so that the interior of the second ink container 125 is still kept in an optimum range of negative pressure to supply ink to the print head FIG. 21A also shows a state in which a gas is present in the second ink container 125 because, for example, the gas was taken into the print head from outside while the ink was consumed.

Figure 21B:
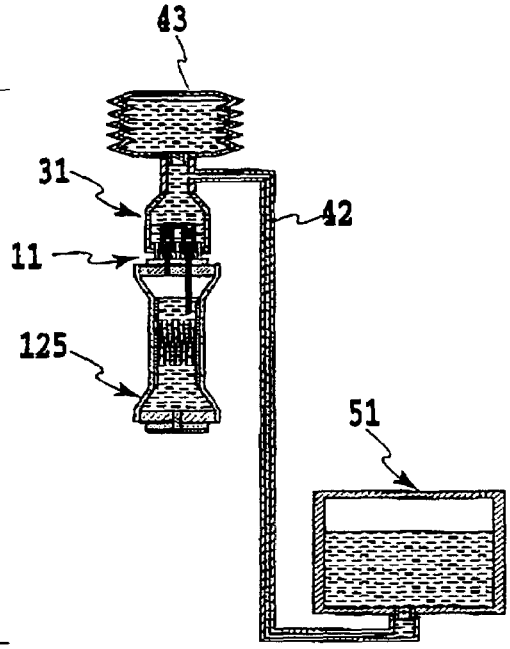

When the ink is supplied into the second ink container 125, the connector 11 and the supply unit 31 are connected, as shown in FIG. 21B. With the connector 11 and the supply unit 31 connected, the negative pressure in the second ink container 125 causes the ink to flow from the first ink container 51 into the second ink container 125, as in the previous embodiment.

Figure 21C:
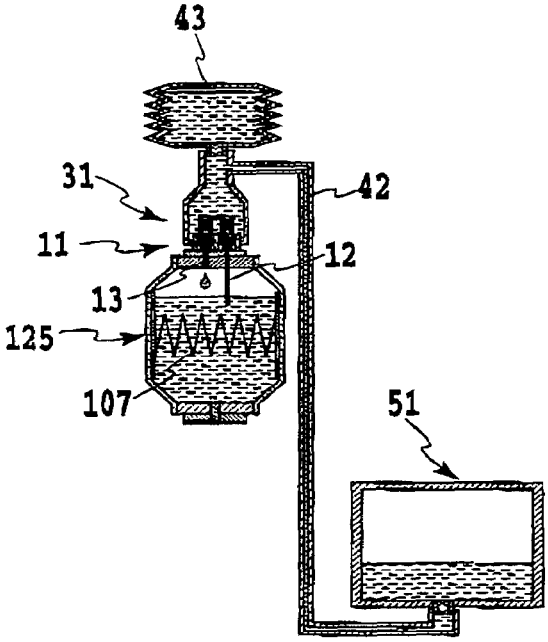
Figure 21D:
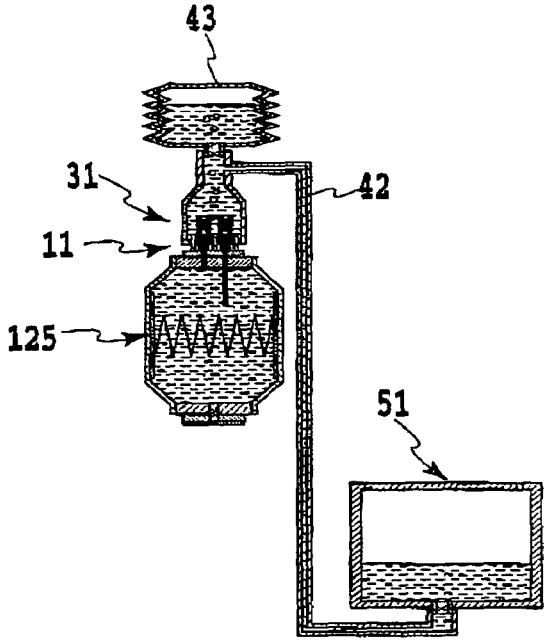

As the flow of ink proceeds in this way, the second ink container 125 inflates, assisted by the recovery force of the spring 107, as shown in FIG. 21C and the ink level in the second ink container 125 progressively rises. At the same time the gas present in the second ink container 125 enters into the gas accommodating chamber 43 through the gas transfer tube 13. As the gas discharged from the second ink container 125 enters into the gas accommodating chamber 43 as shown in FIG. 21D, the ratio of the gas occupying the gas accommodating chamber 43 gradually relatively increases compared to the ink in the gas accommodating chamber 43 which is decreasing in volume flows into the second ink container 125.

Figure 22B:
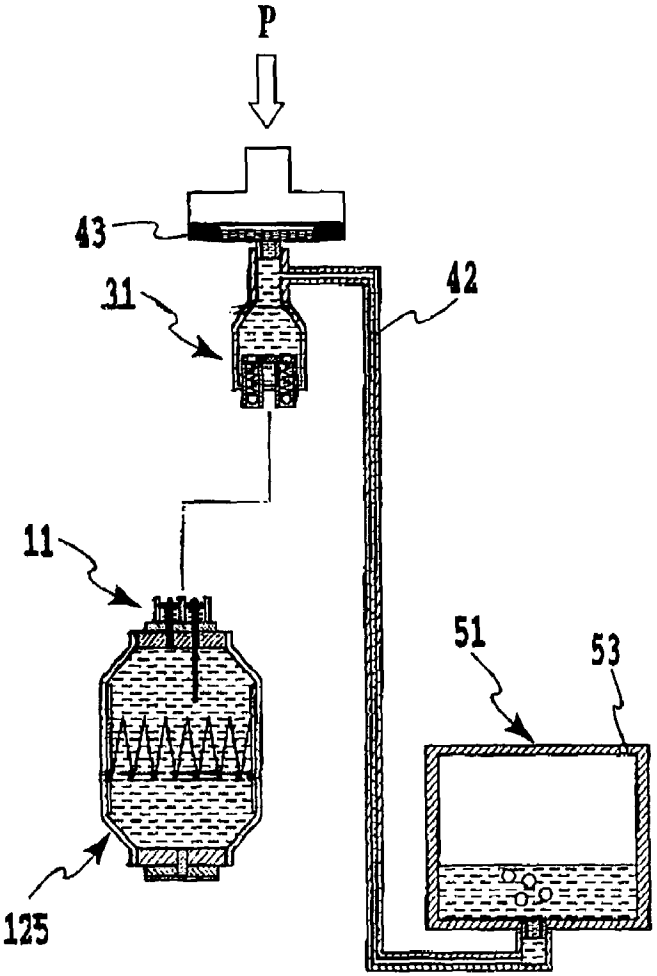
FIGS. 22A and 22B are cross-sectional views showing how the ink supply system in the fourth embodiment of the invention operates.
Figure 22A:
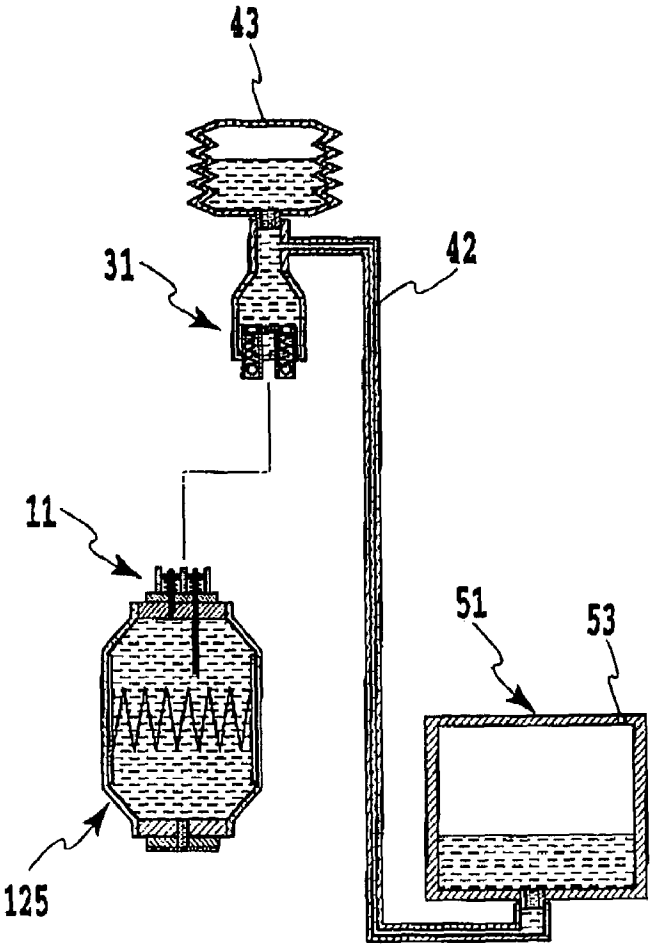

After a series of ink filling and gas discharging operations is finished, the connector 11 is disconnected from the supply unit 31 as shown in FIG. 22A. In this disconnected state, the supply unit 31 is hermetically closed, so that the gas discharged into the gas accommodating chamber 43 remains there.

Next, as shown in FIG. 22B, when an external force P is applied to the gas accommodating chamber 43, the baglike gas accommodating chamber 43 collapses causing the gas therein to flow through the ink path 42 into the first ink container 51. A press means to press the gas accommodating chamber 43 may be installed in the printing apparatus as required.

In this construction, the inner volume of the gas accommodating chamber 43 needs to be set larger than the inner volume of the ink path 42. If the inner volume of the gas accommodating chamber 43 is smaller than that of the ink path 42, there is a possibility that when the gas accommodating chamber 43 recovers its original shape after the gas in the chamber has been delivered to the first ink container 51, the gas may remain in the ink path 42. That is, when the gas accommodating chamber 43 is collapsed by the external force to send the gas from the gas accommodating chamber 43 to the first ink container 51 and then relieved of the external force to return to its original state, causing the ink in the first ink container 51 to flow into the gas accommodating chamber 43, the gas in the ink path 42 cannot be sufficiently replaced with the ink, leaving the gas to remain near the connecting portion between the ink path 42 and the gas accommodating chamber 43. The residual gas may get delivered into the second ink container 125. Therefore, the inner volume of the gas accommodating chamber 43 is set larger than that of the ink path 42.

(Fifth Embodiment)

Figure 23A:
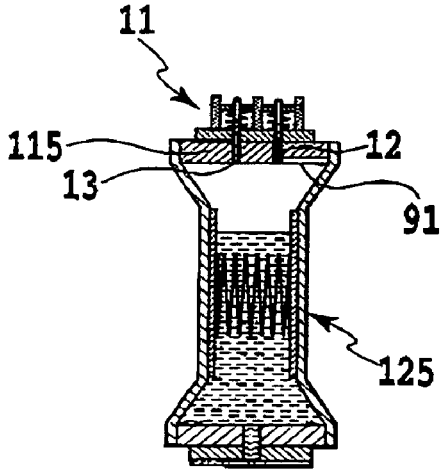
FIGS. 23A and 23B are cross-sectional views showing how an ink supply system in a fifth embodiment of the invention operates.
Figure 23B:
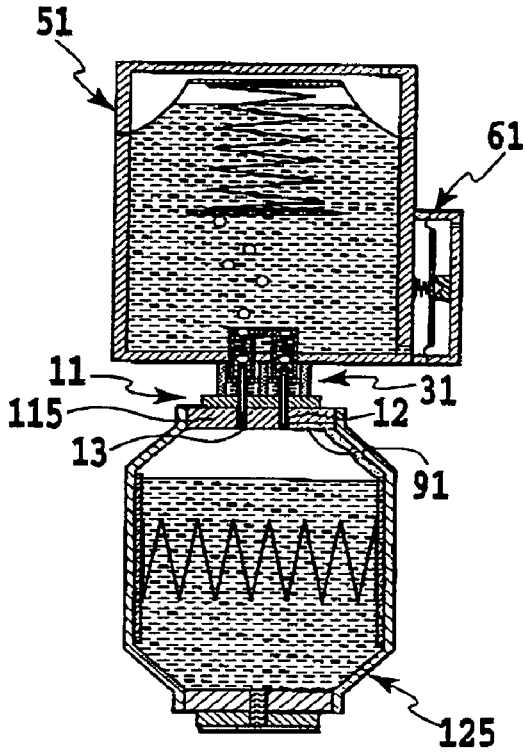

FIGS. 23A and 23B illustrate a fifth embodiment of the invention. This embodiment represents an example construction in which there is practically no height difference between the ink introducing tube and the gas transfer tube, multiple passages formed between the first and second ink containers.

FIG. 23A is a cross-sectional view of the second ink storage area and the connector 11. As shown in the figure, the ink introducing tube 12 and the gas transfer tube 13 provided in the frame (base member) 115 of the second ink container 125 have their lower end openings on the second ink container 125 side situated at almost the same height. A part of the lower end opening of the ink introducing tube 12 on the second ink container 125 side is in contact with a groove 91 formed in the frame 115.

FIG. 23B shows the second ink container 125 connected to the first ink container 51. In this connected state, when there is no height difference between the two flow paths formed by the ink introducing tube 12 and the gas transfer tube 13, there is no difference between the ink meniscus forces produced in the lower end openings of these paths on the second ink container 125 side and therefore the gas transfer does not occur. However, as shown in the figure, since the groove 91 in the frame 115 is in contact with the opening of the ink introducing tube 12, the capillary attraction force of the groove 91 causes the ink to flow down the wall surface, breaking the meniscus in the opening on the ink introducing tube 12 side. According to the volume of ink that has moved into the second ink container 125, the gas pressure in the container 125 increases, which in turn breaks the meniscus in the ink introducing tube 12, allowing the gas in the second ink container 125 to move into the first ink container 51. As described above, even when there is no height difference between the two flow paths, it is possible to transfer the gas.

(Sixth Embodiment)

Figure 24A:
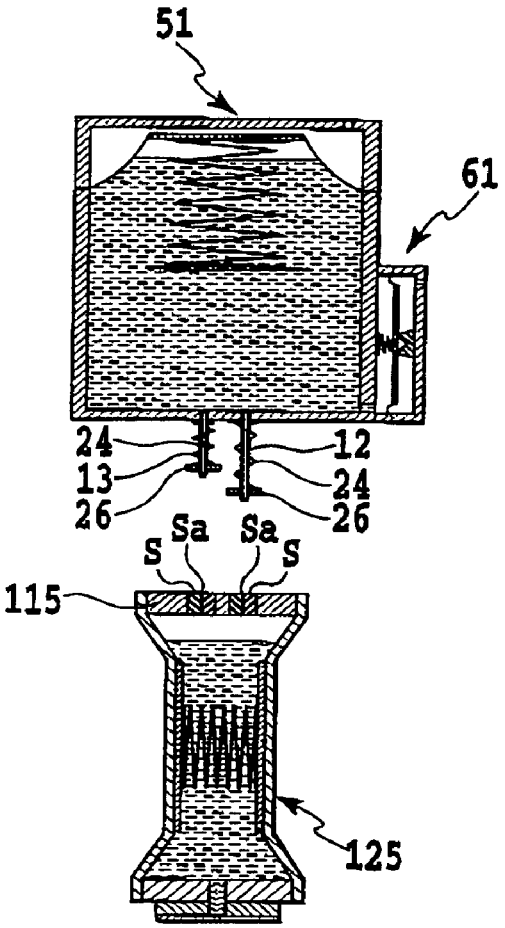
FIGS. 24A and 24B are cross-sectional views showing how an ink supply system in a sixth embodiment of the invention operates.
Figure 24B:
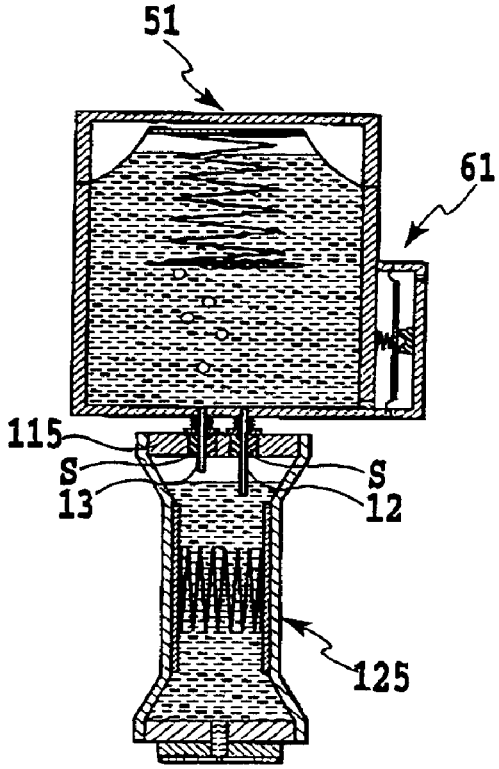

FIGS. 24A and 24B illustrate a sixth embodiment of the invention. This embodiment represents an example construction in which a plurality of flow paths between the first and second ink containers 51, 125 are provided on the first ink container 51 side.

In FIG. 24A, the ink introducing tube 12 and the gas transfer tube 13 are installed on the first ink container 51 side. The lower end openings, with respect to a gravity direction, of the ink introducing tube 12 and the gas transfer tube 13 are differentiated in height and hermetically closed with a seal member (seal rubber) 26. The seal rubber 26 is urged downward by a spring 24 and is prevented by a stopper not shown from coming off. When, as shown in FIG. 24A, the first and second ink containers 51, 125 are not connected, the lower end openings of the ink introducing tube 12 and the gas transfer tube 13 are closed by the seal rubbers 26. The frame 115 of the second ink container 125 is provided with seal members S each formed with a slit Sa. In the state of FIG. 24A, the seal members S close the slits Sa by their elasticity, sealing the second ink container 125.

When, as shown in FIG. 24B, the first and second ink containers 51, 125 are connected, the ink introducing tube 12 and the gas transfer tube 13 pass through the slits Sa in the corresponding seal members S into the second ink container 125. At this time, the seal rubbers 26 open the lower end openings of the ink introducing tube 12 and the gas transfer tube 13, communicating the interiors of the first and second ink containers 51, 125 with each other. The inner surfaces of the slits Sa of the seal members S come into hermetic contact with outer circumferential surfaces of the ink introducing tube 12 and the gas transfer tube 13 for an airtight seal.

In this example, too, the ink supply and the gas release are simultaneously performed by a mechanism similar to that of the third embodiment.

(Seventh Embodiment)

Figure 25:
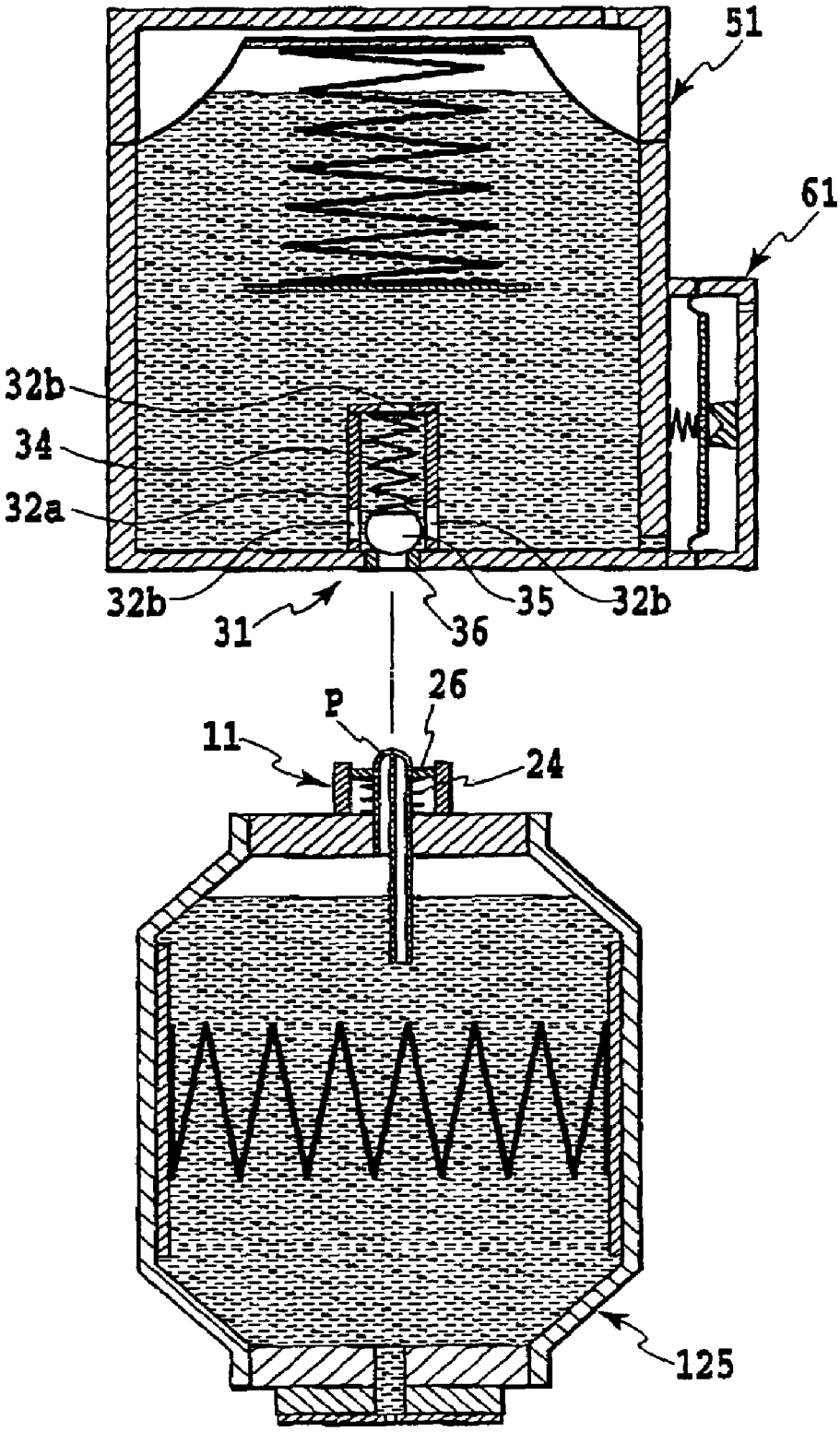
FIG. 25 is a cross-sectional view showing an outline construction of an ink supply system in a seventh embodiment of the present invention.

FIG. 25 illustrates a seventh embodiment of the invention, in which a plurality of flow paths situated between the first and second ink containers 51, 125 are constructed integral as one structure.

In the preceding embodiments, the flow paths are formed of separate members, i.e., the ink introducing tube 12 and the gas transfer tube 13. It is also possible to divide the interior of one tube P into two to form two flow paths, as shown in FIG. 25. In the interior of the tube P a right-side portion functions as the ink introducing tube 12 and a left-side portion as the gas transfer tube 13. In FIG. 25, the tube P is installed in the connector 11 on the second ink container 125 side and constructed in the similar manner to the tube of FIG. 4A. Parts identical with those of FIG. 4A are assigned like reference numbers and their explanations are omitted.

By forming a plurality of flow paths in one tube, the number of tubes required to be installed can be reduced, which in turn makes it possible to reduce an insertion force for connecting and disconnecting the first and second ink containers 51, 125 and reduce limitations on their positional accuracy.

(Eighth Embodiment)

Figure 26:
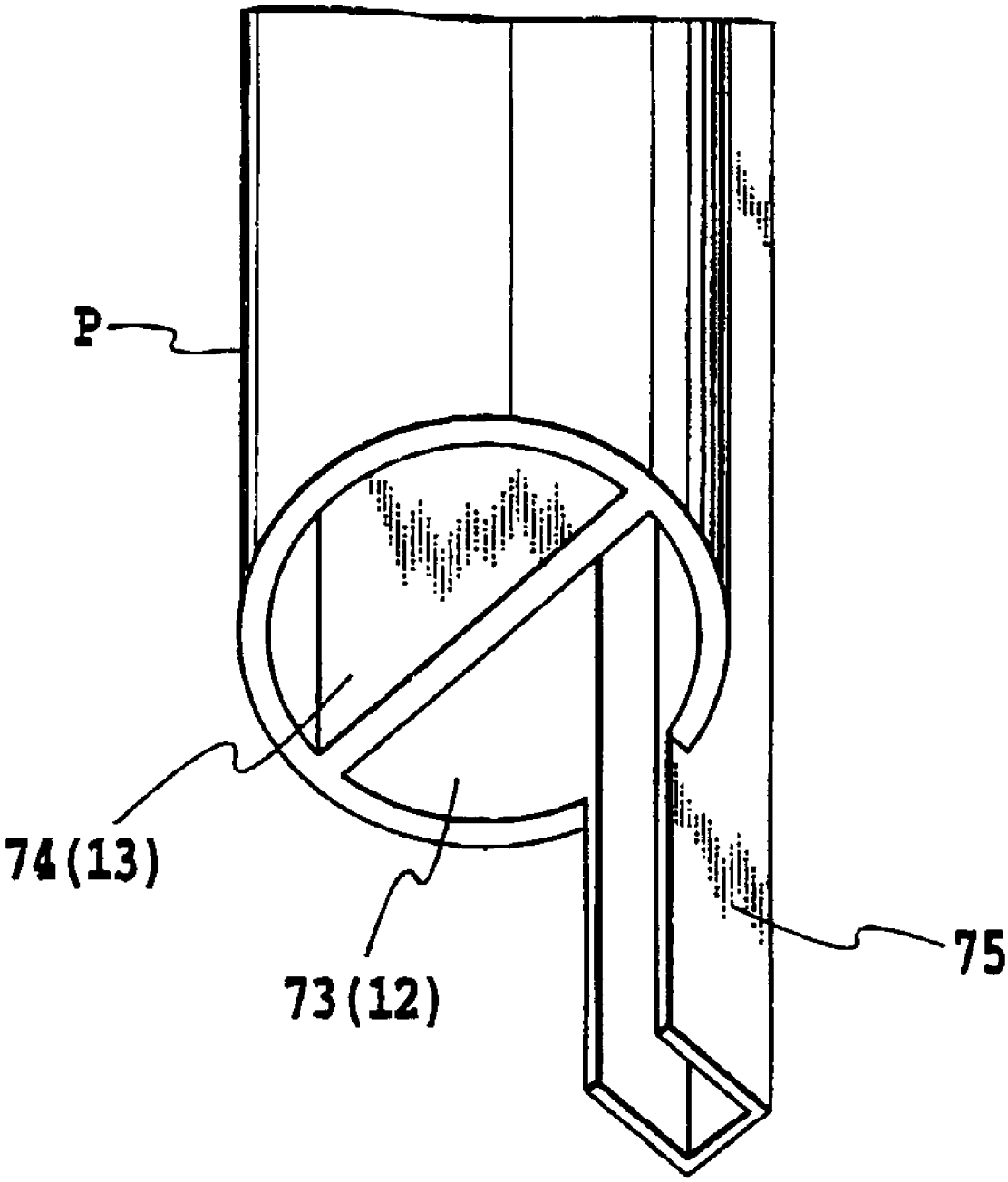
FIG. 26 is a perspective view showing a construction of an essential portion of a communication path in an eighth embodiment of the present invention.

FIG. 26 illustrates an eighth embodiment of the invention. In this embodiment, two flow paths between the first and second ink containers 51, 125 are formed by a single tube P, with one flow path 73 functioning as the ink introducing tube 12 and the other 74 as the gas transfer tube 13. Further, the tube P is provided with a portion 75 that forms a fine groove along the ink path. The portion 75 extends downward from an opening of the flow path 73 on the print head side. The portion 75 protrudes downward from an upper inner surface of the second ink container 125.

In this construction, since the ink enters into the fine groove of the portion 75 by the capillary attraction, a meniscus with a high surface tension is not formed at the opening of the flow path 73 on the print head side. As a result, the ink easily flows down the path 73 into the second ink container 125. That is, in this embodiment, too, even if there is no height difference between the openings, on the print head side, of the ink flow path 73 and the gas flow path 74, the ink delivery and the gas transfer are performed, producing the similar effect to that of the fifth embodiment described earlier.

The construction that prevents the formation of a meniscus with a high surface tension in the opening of the ink flow path on the print head side is not limited to those of the fifth and eighth embodiments. For example, the opening may be increased in size, a plurality of flow paths may be differentiated in inner diameter, or conditions of inner surfaces of the flow paths (contact angles with ink) may be differentiated by an appropriate selection of materials or surface treatments. These measures can be expected to produce the similar effects.

(Ninth Embodiment)

Figure 27:
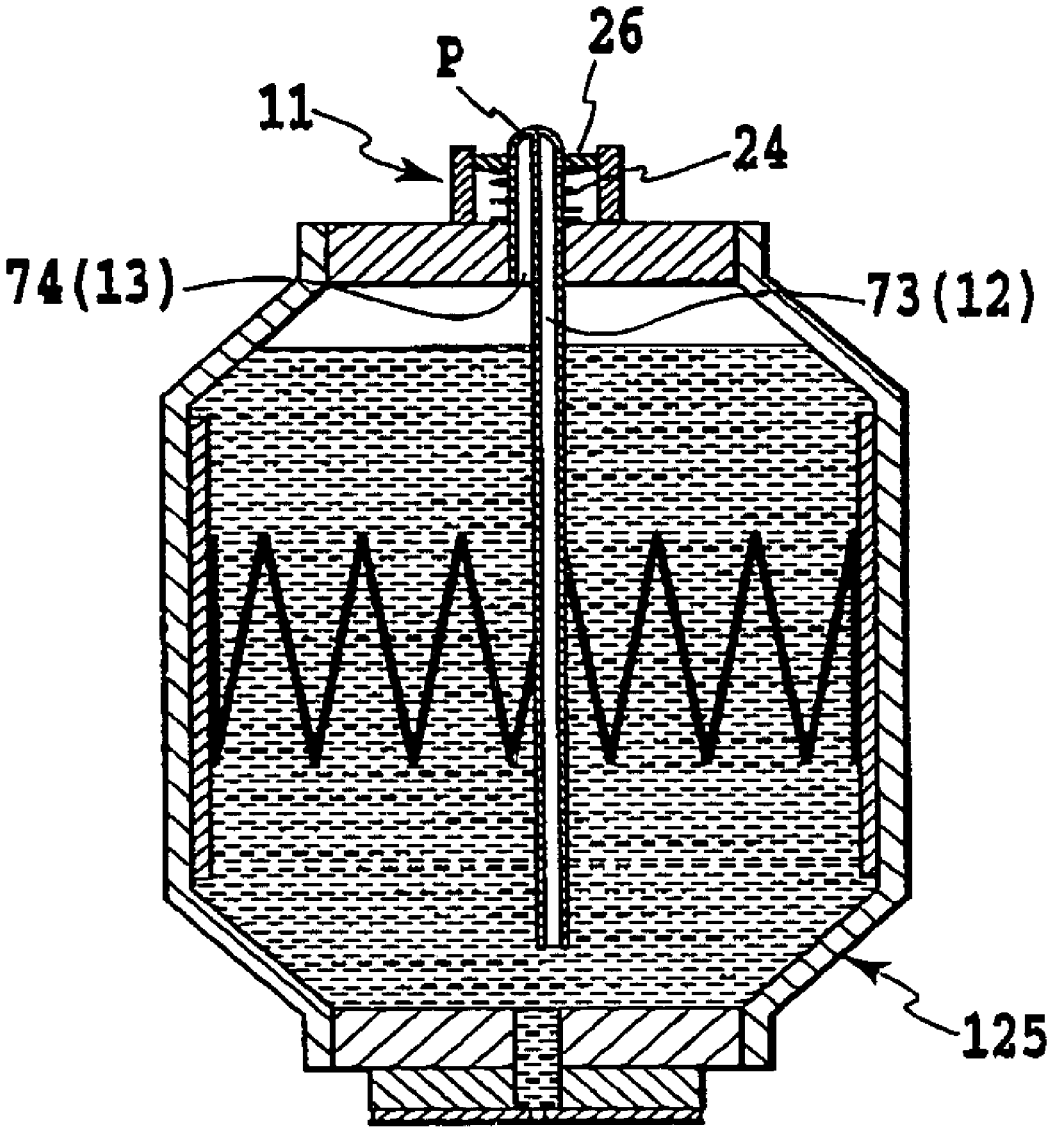
FIG. 27 is across-sectional view showing a construction of a second ink container in a ninth embodiment of the present invention.

FIG. 27 illustrates a second ink container 125 in a ninth embodiment of the invention.

In this example, the flow path 73 in FIG. 26 extends downward so that its opening on the print head side is situated near a bottom of the second ink container 125. In this construction the opening of the flow path 73 on the print head side is always in contact with ink in the second ink container 125. Thus, as long as the condition of equation (4) is satisfied, a gas is transferred at all times and there is no need to consider the situation where the state of FIG. 19B described earlier is likely to occur. It is also possible to provide around the opening of the flow path 73 on the print head side an ink accommodating chamber to ensure that the opening is always kept in contact with the ink.

(Other Embodiments)

In the above embodiments two communication paths, the ink introducing tube 12 and the gas discharge tube (gas transfer tube) 13, are formed between the first ink tank 51 as the ink container and the second ink tank 125 as the ink refilling container. Three or more communication paths may be formed between the first ink tank 51 and the second ink tank 125. The only requirement is an ability to discharge the gas from the second ink tank 125 into the first ink tank 51 through at least one communication path and at the same time supply the ink from the first ink tank 51 into the second ink tank 125 through at least one other communication path.

As described above, the functions of the communication paths formed by the ink introducing tube 12 and the gas discharge tube 13 are not limited to the supply of ink and the discharge of gas. For example, when the ink is introduced from the first ink tank 51 by the negative pressure in the second ink tank 125, both communication paths, the ink introducing tube 12 and gas discharge tube 13, are used for delivering the ink. Then, as the inner pressure in the second ink tank 125 increases, the gas in the second ink tank 125 is discharged through a relatively short gas discharge tube 13, a communication path through which the gas can more easily escape than through the other tube, and at the same time the ink is supplied through the other communication path or ink introducing tube 12. Then, after the lower end opening of the ink introducing tube 12 is submerged in the ink, the functions of these communication paths are clearly differentiated, with the gas discharge tube 13 assigned to discharge gas and the ink introducing tube 12 assigned to introduce ink. When the ink level in the second ink tank 125 reaches the gas discharge tube 13, the supply of ink is stopped. Therefore, it is possible to supply a desired amount of ink into the second ink tank 125 depending on where in a vertical direction the lower end opening of the gas discharge tube 13 is situated. As a result, a predetermined amount of ink that fills the second ink tank 125 to its capacity can be supplied into the second ink tank 125.

The communication paths may be constructed so that each of them can perform both of the ink introducing and the gas discharging functions until its lower end submerges in the ink in the second ink tank 125. Further, by differentiating flow resistances of fluids (ink and gas) in these communication paths by using different inner diameters and materials for the paths, the communication paths can be given roughly different functions, such as an ink introducing function and a gas discharging function. Further, by taking advantage of small differences in fluid flow resistance between the communication paths due to manufacturing variations the functions of the communication paths may be distinguished roughly between an ink introduction and a gas discharge. Therefore, if a plurality of communication paths are formed in the same configuration, it is possible to smoothly supply ink through at least one of the communication paths while at the same time extracting gas from at least one other communication path.

These communication paths may be formed of the corresponding number of tubes or formed in a single tube For example, a double tube may be used to form a communication path in a central part of the tube and another communication path on an outer circumferential side. The only requirement is that a partition wall in a single tube needs to divide the interior of the tube completely or incompletely to form a plurality of communication paths.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink supply system comprising:

a first ink storage area having a first ink container to store ink, negative pressure generating means to generate negative pressure in the first ink container, and connecting means through which the ink is supplied; and a second ink storage area connected to the first ink storage area through said connecting means to introduce the ink from the first ink storage area for supply to a print head; and a means which, when the connecting means disconnects a connecting portion on the second ink storage area side from a connecting portion on the first ink storage area side, hermetically closes the connecting portion on the first ink storage area side;

wherein the connecting means disconnectably connects the second ink storage area to the first ink storage area and, when the two ink storage areas are connected, forms a plurality of communication paths communicating the two ink storage areas with each other;

wherein the second ink storage area, excluding the plurality of communication paths and a connecting portion with the print head, virtually forms a hermetically closed space;

wherein, when the ink is refilled into the second ink storage area from the first ink storage area through at least one of the plurality of communication paths, a gas present in the second ink storage area can be transferred to the first ink storage area through at least one other communication path;

wherein at least a part of the first ink storage area is situated higher in the gravity direction than the connecting means;

wherein the first ink storage area is provided with a gas accommodating chamber which is installed higher than the connecting means and accommodates a gas transferred from the second ink storage area; and wherein said first ink storage area further comprises means to reduce an internal volume of the accommodating chamber.

2. An ink supply system as claimed in claim 1, wherein the first ink storage area has a means to introduce an atmosphere into the first ink storage area, without passing the atmosphere through the second ink storage area.

3. An ink supply system as claimed in claim 1, wherein the plurality of communication paths have their openings on the first ink storage area side situated higher in a gravity direction than their openings on the second ink storage area side and also have an opening of the at least one communication path on the second ink storage area side situated higher in the gravity direction than an opening of the at least one other communication path on the second ink storage area side.

4. An ink supply system as claimed in claim 1, wherein, based on a relationship between a pressure that the ink in the first ink storage area applies to the hermetically closed space of the second ink storage area, and a force of an ink meniscus formed in the at least one of the plurality of communication paths, a gas present in the second ink storage area is transferred into the first ink storage area through the at least one communication path while at the same time the ink is supplied from the first ink storage area into the second ink storage area through the at least one other communication path.

5. An ink supply system as claimed in claim 1, wherein the opening, on the second ink storage area side, of the at least one of the plurality of communication paths is formed in contact with an inner wall of a container forming the second ink storage area.

6. An ink supply system as claimed in claim 1, wherein the opening, on the second ink storage area side, of the at least one of the plurality of communication paths is formed with a groove that extends along the communication path toward the inside of the second ink storage area.

7. An ink supply system as claimed in claim 1, wherein the opening, on the second ink storage area side, of the at least one of the plurality of communication paths is in contact at all times with the ink in the second ink storage area.

8. An ink supply system as claimed in claim 1, wherein the plurality of communication paths have different contact angles between the inner wall thereof and the ink.

9. An ink supply system as claimed in claim 1, wherein the plurality of communication paths have different inner diameters.

10. An ink supply system as claimed in claim 1, wherein the second ink container is formed deformable.

11. An ink supply system as claimed in claim 1, wherein the second ink container has a negative pressure generation means to generate a negative pressure therein.

12. An ink supply system as claimed in claim 1, wherein the first ink container has:

a movable member in at least a part thereof that defines an ink storage space and which, as the ink is supplied into the second ink storage area, can be displaced in a direction that reduces the ink storage space.

13. An ink supply system as claimed in claim 12, wherein the first ink container has a member that urges the movable member in a direction opposite the direction in which the movable member can be displaced.

14. An ink supply system as claimed in claim 1, wherein the first ink container has an atmosphere introducing means to introduce external air into the ink storage space from outside as the ink is supplied from the ink storage space into the second ink storage area.

15. An ink supply system as claimed in claim 1, wherein the first ink container can be replaced after the ink therein is consumed.

16. An ink supply system as claimed in claim 1, wherein the gas accommodating chamber is deformable.

17. An ink supply system as claimed in claim 16, wherein the gas accommodating chamber has a maximum internal volume which is larger than an internal volume of an ink path, the ink path introducing the ink from the first ink container to the connecting means.

18. An ink supply system as claimed in claim 1, wherein the means to reduce the internal volume of the gas accommodating chamber is a means to press the gas accommodating chamber.

19. An ink jet printing apparatus for printing an image on a print medium by using an ink jet print head, the printing apparatus having an ink supply system defined in any one of claims 1 to 9, 10, 11, 12 to 15, or 16 to 18 as a system to supply ink to the ink jet print head.

20. An ink jet printing apparatus as claimed in claim 19, further comprising:

a means to move the print head in a main scan direction; and a transport means to transport the print medium in a subscan direction crossing the main scan direction;

wherein the first ink storage area is installed at a predetermined position in a body of the printing apparatus;

wherein the second ink storage area is installed movable wit the print head;

wherein the connecting means, when the print head moves to a predetermined position in the main scan direction, connects the second ink storage area to the first ink storage area and, when the print head moves away from the predetermined position, disconnects the second ink storage area from the first ink storage area.

* * * * *

UNITED STATES PATENT AND TRADEMARK OFFICE

CERTIFICATE OF CORRECTION

PATENT NO. : 6,969,161 B2
APPLICATION NO. : 10/671619
DATED : November 29, 2005
INVENTOR(S) : Nobuyuki et al.

It is certified that error appears in the above-identified patent and that said Letters Patent is hereby corrected as shown below:

COLUMN 6

Line 33, “across-sectional” should read --a cross-sectional--; and
Line 52, “sprint paper” should read --print paper--.

COLUMN 20

Line 18, “tube 13 is” should read --tube 13 and the ink level in the second ink container 125, (HS-Ha), is--.

COLUMN 24

Line 6, “consumed” should read --consumed.--; and
Line 9, “head” should read --head.--.

COLUMN 27

Line 66, “tube” should read --tube.--.

COLUMN 30

Line 36, “wit” should read --with--.

Signed and Sealed this

Twenty-second Day of August, 2006

JON W. DUDAS
*Director of the United States Patent and Trademark Office*